US005930924A

United States Patent [19]

Beard

[11] Patent Number: 5,930,924

[45] Date of Patent: Aug. 3, 1999

[54] PERPETUAL CALENDAR

[76] Inventor: Carolyn T. Beard, 4801 Oak Park Rd., Raleigh, N.C. 27612

[21] Appl. No.: 08/848,489

[22] Filed: May 8, 1997

[51] Int. Cl.[6] ..... G09D 3/00

[52] U.S. Cl. ..... 40/107; 40/491; 283/2

[58] Field of Search ..... 40/107, 491; 283/2

[56] References Cited

U.S. PATENT DOCUMENTS

| | | | |
|---|---|---|---|
| 1,251,195 | 12/1917 | Dyer | 40/107 |
| 1,542,743 | 6/1925 | Stevenson | 283/2 |
| 1,740,497 | 12/1929 | Coleman | 40/107 |
| 1,769,759 | 7/1930 | Stimson et al. | 40/107 |
| 2,340,153 | 1/1944 | Stewart | 40/107 |
| 3,140,552 | 7/1964 | Mader | 40/491 X |
| 3,248,809 | 5/1966 | Stifano, Jr. | 40/491 X |
| 3,584,597 | 6/1971 | Simmons | 40/491 X |
| 3,596,390 | 8/1971 | Scalice | 40/491 |
| 4,828,290 | 5/1989 | Harris | 283/2 X |

*Primary Examiner*—Joanne Silbermann
*Attorney, Agent, or Firm*—Rhodes, Coats, & Bennett, LLP

[57] ABSTRACT

A perpetual calendar that simultaneously and individually displays all twelve months of any predetermined year. The perpetual calendar includes an outer housing sleeve having twelve month-windows, a middle panel movably disposed inside the sleeve, and a numerical calendar grid adorning the middle panel behind the month-windows. The preferred embodiment of the perpetual calendar also includes positioning structure for orienting the middle panel and therefore the calendar grid among fourteen possible yearly positions, as well as indicia for displaying the current yearly position in which the calendar is oriented. The calendar grid includes twelve month-grids that are each configured to display only a single particular month of the year and to display the precise number of days in that particular month. Each of the month-grids includes a common year grid movable among seven common year positions and an adjacent leap year grid movable among seven leap year positions. The positioning structure positions the middle panel in one of the fourteen yearly positions according to calculated yearly chronology, thereby resulting in the twelve month-grids being oriented in the month-windows in such a manner as to display the dates of any predetermined year.

21 Claims, 21 Drawing Sheets

| | | | | | | | | | | | | |
|---|---|---|---|---|---|---|---|---|---|---|---|---|
| | | | | | | | | | | | | 1 |
| | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | 31 | | |
| 28 | 29 | 30 | 31 | | | | | | | | | |

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | | | | | | | |

| | | | | | | | | | | | | |
|---|---|---|---|---|---|---|---|---|---|---|---|---|
| | | | | | 1 | 2 | 3 | 4 | 5 | 6 | 7 | |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

| | | | | | | | | | | | | |
|---|---|---|---|---|---|---|---|---|---|---|---|---|
| | | | | | | | | 1 | 2 | 3 | 4 | |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | 31 | |
| 27 | 28 | 29 | 30 | 31 | | | | | | | | |

| | | | | | | | | | | | | |
|---|---|---|---|---|---|---|---|---|---|---|---|---|
| | | | | | | | | | | | | 1 |
| | | | | 1 | 2 | 3 | 4 | 5 | 6 | 7 | 8 | |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| 24 | 25 | 26 | 27 | 28 | 29 | 30 | | | | | | |

| | | | | | | | | | | | | |
|---|---|---|---|---|---|---|---|---|---|---|---|---|
| | | | | | 1 | 2 | 3 | 4 | 5 | 6 | 7 | |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

| | | | | | | | | | | | | |
|---|---|---|---|---|---|---|---|---|---|---|---|---|
| | | | | | | | | 1 | 2 | 3 | 4 | |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | | |
| 27 | 28 | 29 | 30 | | | | | | | | | |

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

| | | | | | | | | | | | | |
|---|---|---|---|---|---|---|---|---|---|---|---|---|
| | | | | | | 1 | 2 | 3 | 4 | 5 | 6 | |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | 31 | | | |
| 29 | 30 | 31 | | | | | | | | | | |

| | | | | | | | | | | | | |
|---|---|---|---|---|---|---|---|---|---|---|---|---|
| | | | | | | | | 1 | 2 | 3 | | |
| | | | | 1 | 2 | 3 | 4 | 5 | 6 | 7 | 8 | 9 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | |
| 26 | 27 | 28 | 29 | 30 | | | | | | | | |

| | | | | | | | | | | | | |
|---|---|---|---|---|---|---|---|---|---|---|---|---|
| | | | | | | | | | | | | 1 |
| | | | | 1 | 2 | 3 | 4 | 5 | 6 | 7 | 8 | |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

FIG.6A-2

Grid-3

Grid-4

Grid-5

70

FIG. 6E-1

Jan

| | | | | | | | | | | | | |
|---|---|---|---|---|---|---|---|---|---|---|---|---|
| | | | | | | | | | 1 | 2 | 3 | |
| | | | 1 | 2 | 3 | 4 | 5 | 6 | 7 | 8 | 9 | 10 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | 31 |
| 26 | 27 | 28 | 29 | 30 | 31 | | | | | | | |

Feb

| | | | | | | | | | | | | |
|---|---|---|---|---|---|---|---|---|---|---|---|---|
| | | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | | | | | | | |

Mar

| | | | | | | | | | | | | |
|---|---|---|---|---|---|---|---|---|---|---|---|---|
| | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

| | | | | | | | | | | | | |
|---|---|---|---|---|---|---|---|---|---|---|---|---|
| | | | | | | | | | 1 | 2 | 3 | |
| | | | 1 | 2 | 3 | 4 | 5 | 6 | 7 | 8 | 9 | 10 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | 31 |
| 26 | 27 | 28 | 29 | 30 | 31 | | | | | | | |

| | | | | | | | | | | | | |
|---|---|---|---|---|---|---|---|---|---|---|---|---|
| | | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | | | | | | |

| | | | | | | | | | | | | |
|---|---|---|---|---|---|---|---|---|---|---|---|---|
| | | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | 31 | | | |
| 29 | 30 | 31 | | | | | | | | | | |

Apr

| | | | | | | | | | | | | |
|---|---|---|---|---|---|---|---|---|---|---|---|---|
| | | | | | | | | 1 | 2 | 3 | 4 | |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | | |
| 27 | 28 | 29 | 30 | | | | | | | | | |

May

| | | | | | | | | | | | | |
|---|---|---|---|---|---|---|---|---|---|---|---|---|
| | | | | | | | | | | | 1 | 2 |
| | | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

Jun

| | | | | | | | | | | | | |
|---|---|---|---|---|---|---|---|---|---|---|---|---|
| | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | | | | |
| 29 | 30 | | | | | | | | | | | |

| | | | | | | | | | | | | |
|---|---|---|---|---|---|---|---|---|---|---|---|---|
| | | | | | | | | | 1 | 2 | 3 | 4 | 5 |
| | | | 1 | 2 | 3 | 4 | 5 | 6 | 7 | 8 | 9 | 10 | 11 |
| 5 | 6 | 7 | 8 | 9 | 10 | 11 | 12 | 13 | 14 | 15 | 16 | 17 | 18 |
| 12 | 13 | 14 | 15 | 16 | 17 | 18 | 19 | 20 | 21 | 22 | 23 | 24 | 25 |
| 19 | 20 | 21 | 22 | 23 | 24 | 25 | 26 | 27 | 28 | 29 | 30 | | |
| 26 | 27 | 28 | 29 | 30 | | | | | | | | | |

| | | | | | | | | | | | | |
|---|---|---|---|---|---|---|---|---|---|---|---|---|
| | | | | | | | | | | | | 1 |
| | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | | | |
| 28 | 29 | 30 | | | | | | | | | | |

Jul

| | | | | | | | | | | | | |
|---|---|---|---|---|---|---|---|---|---|---|---|---|
| | | | | | | | | | 1 | 2 | 3 | 4 |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | 31 | |
| 27 | 28 | 29 | 30 | 31 | | | | | | | | |

Aug

| | | | | | | | | | | | | |
|---|---|---|---|---|---|---|---|---|---|---|---|---|
| | | | | | | | | | | | | 1 |
| | | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

Sep

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | | | |
| 28 | 29 | 30 | | | | | | | | | | |

| | | | | | | | | | | | | |
|---|---|---|---|---|---|---|---|---|---|---|---|---|
| | | | | | | | | | 1 | 2 | 3 | |
| | | 1 | 2 | 3 | 4 | 5 | 6 | 7 | 8 | 9 | 10 | |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | 31 |
| 26 | 27 | 28 | 29 | 30 | 31 | | | | | | | |

| | | | | | | | | | | | | |
|---|---|---|---|---|---|---|---|---|---|---|---|---|
| | | | | | | | | 1 | 2 | 3 | 4 | 5 |
| | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

| | | | | | | | | | | | | |
|---|---|---|---|---|---|---|---|---|---|---|---|---|
| | | | | | | | | | 1 | 2 | 3 | 4 |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | | |
| 27 | 28 | 29 | 30 | | | | | | | | | |

Oct

| | | | | | | | | | | | | |
|---|---|---|---|---|---|---|---|---|---|---|---|---|
| | | | | | | | | | 1 | 2 | 3 | |
| | | 1 | 2 | 3 | 4 | 5 | 6 | 7 | 8 | 9 | 10 | |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | 31 |
| 26 | 27 | 28 | 29 | 30 | 31 | | | | | | | |

Nov

| | | | | | | | | | | | | |
|---|---|---|---|---|---|---|---|---|---|---|---|---|
| | | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | | | | | |
| 30 | | | | | | | | | | | | |

Dec

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | 31 | | |
| 28 | 29 | 30 | 31 | | | | | | | | | |

| | | | | | | | | | | | | |
|---|---|---|---|---|---|---|---|---|---|---|---|---|
| | | | | | | | | | | 1 | 2 | |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

| | | | | | | | | | | | | |
|---|---|---|---|---|---|---|---|---|---|---|---|---|
| | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | | | | |
| 29 | 30 | | | | | | | | | | | |

| | | | | | | | | | | | | |
|---|---|---|---|---|---|---|---|---|---|---|---|---|
| | | | | | | | | 1 | 2 | 3 | 4 | |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | 31 | |
| 27 | 28 | 29 | 30 | 31 | | | | | | | | |

Fig. 6E-2

Grid-6

70

Fig.6F-1

Jan

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

Feb

| | | | | | | | | | | | | |
|---|---|---|---|---|---|---|---|---|---|---|---|---|
| | | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | | | | | | |

Mar

| | | | | | | | | | | | | |
|---|---|---|---|---|---|---|---|---|---|---|---|---|
| | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | 31 | | | |
| 29 | 30 | 31 | | | | | | | | | | |

| | | | | | | | | | | | | |
|---|---|---|---|---|---|---|---|---|---|---|---|---|
| | | | | | | | | 1 | 2 | 3 | 4 | 5 |
| | | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | | | | | |

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | 31 | | |
| 28 | 29 | 30 | 31 | | | | | | | | | |

Apr

| | | | | | | | | | | | | |
|---|---|---|---|---|---|---|---|---|---|---|---|---|
| | | | | | | | | | | 1 | 2 | 3 |
| | | | 1 | 2 | 3 | 4 | 5 | 6 | 7 | 8 | 9 | 10 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | |
| 26 | 27 | 28 | 29 | 30 | 31 | | | | | | | |

May

| | | | | | | | | | | | | |
|---|---|---|---|---|---|---|---|---|---|---|---|---|
| | | | | | | | | | | | | 1 |
| | | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

Jun

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | | | |
| 28 | 29 | 30 | | | | | | | | | | |

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | | | | | | | |

| | | | | | | | | | | | | |
|---|---|---|---|---|---|---|---|---|---|---|---|---|
| | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

| | | | | | | | | | | | | |
|---|---|---|---|---|---|---|---|---|---|---|---|---|
| | | | | | | | | 1 | 2 | 3 | 4 | |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | | |
| 27 | 28 | 29 | 30 | | | | | | | | | |

Jul

| | | | | | | | | | | | | |
|---|---|---|---|---|---|---|---|---|---|---|---|---|
| | | | | | | | | | | 1 | 2 | 3 |
| | | | 1 | 2 | 3 | 4 | 5 | 6 | 7 | 8 | 9 | 10 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | 31 |
| 26 | 27 | 28 | 29 | 30 | 31 | | | | | | | |

Aug

| | | | | | | | | | | | | |
|---|---|---|---|---|---|---|---|---|---|---|---|---|
| | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

Sep

| | | | | | | | | | | | | |
|---|---|---|---|---|---|---|---|---|---|---|---|---|
| | | | | | | | | | 1 | 2 | 3 | 4 |
| | 1 | 2 | 3 | 4 | 5 | 6 | 7 | 8 | 9 | 10 | 11 | |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | | |
| 27 | 28 | 29 | 30 | | | | | | | | | |

| | | | | | | | | | | | | |
|---|---|---|---|---|---|---|---|---|---|---|---|---|
| | | | | | | | | | | 1 | 2 | |
| | | | 1 | 2 | 3 | 4 | 5 | 6 | 7 | 8 | 9 | |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

| | | | | | | | | | | | | |
|---|---|---|---|---|---|---|---|---|---|---|---|---|
| | | | | | | | | 1 | 2 | 3 | 4 | 5 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | 31 | | | |
| 29 | 30 | 31 | | | | | | | | | | |

| | | | | | | | | | | | | |
|---|---|---|---|---|---|---|---|---|---|---|---|---|
| | | | | | | | | | | 1 | 2 | 3 |
| | | | 1 | 2 | 3 | 4 | 5 | 6 | 7 | 8 | 9 | 10 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | |
| 26 | 27 | 28 | 29 | 30 | | | | | | | | |

Oct

| | | | | | | | | | | | | |
|---|---|---|---|---|---|---|---|---|---|---|---|---|
| | | | | | | | | | | 1 | 2 | |
| | | | 1 | 2 | 3 | 4 | 5 | 6 | 7 | 8 | 9 | |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

Nov

| | | | | | | | | | | | | |
|---|---|---|---|---|---|---|---|---|---|---|---|---|
| | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | | | | |
| 29 | 30 | | | | | | | | | | | |

Dec

| | | | | | | | | | | | | |
|---|---|---|---|---|---|---|---|---|---|---|---|---|
| | | | | | | | | | | 1 | 2 | 3 |
| | | | | | | | | | | 1 | 2 | 3 |
| | 1 | 2 | 3 | 4 | 5 | 6 | 7 | 8 | 9 | 10 | 11 | |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | 31 | |
| 27 | 28 | 29 | 30 | 31 | | | | | | | | |

| | | | | | | | | | | | | |
|---|---|---|---|---|---|---|---|---|---|---|---|---|
| | | | | | | | | | | | | 1 |
| | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

| | | | | | | | | | | | | |
|---|---|---|---|---|---|---|---|---|---|---|---|---|
| | | | | | | | 1 | 2 | 3 | 4 | 5 | |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | | | |
| 28 | 29 | 30 | | | | | | | | | | |

| | | | | | | | | | | | | |
|---|---|---|---|---|---|---|---|---|---|---|---|---|
| | | | | | | | | | | 1 | 2 | 3 |
| | | | 1 | 2 | 3 | 4 | 5 | 6 | 7 | 8 | 9 | 10 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | 31 |
| 26 | 27 | 28 | 29 | 30 | 31 | | | | | | | |

Fig. 6F-2

Grid-7

FIG 6G-1

70

Jan

| | | | | | | | | | | | | |
|---|---|---|---|---|---|---|---|---|---|---|---|---|
| | | | | | | | | | | | | 1 |
| | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

Feb

| | | | | | | | | | | | | |
|---|---|---|---|---|---|---|---|---|---|---|---|---|
| | | | | | | | 1 | 2 | 3 | 4 | 5 | |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | | | | | |
| 28 | | | | | | | | | | | | |

Mar

| | | | | | | | | | | | | |
|---|---|---|---|---|---|---|---|---|---|---|---|---|
| | | | | | | | 1 | 2 | 3 | 4 | 5 | |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | 31 | | |
| 28 | 29 | 30 | 31 | | | | | | | | | |

| | | | | | | | | | | | | |
|---|---|---|---|---|---|---|---|---|---|---|---|---|
| | | | | | | | | | | | | 1 |
| | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| * | 25 | 26 | 27 | 28 | 29 | 30 | 31 | | | | | |

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | | | | |
| 28 | 29 | | | | | | | | | | | |

| | | | | | | | | | | | | |
|---|---|---|---|---|---|---|---|---|---|---|---|---|
| | | | | | | | | 1 | 2 | 3 | 4 | |
| | 1 | 2 | 3 | 4 | 5 | 6 | 7 | 8 | 9 | 10 | 11 | |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | 31 | |
| 27 | 28 | 29 | 30 | 31 | | | | | | | | |

Apr

| | | | | | | | | | | | | |
|---|---|---|---|---|---|---|---|---|---|---|---|---|
| | | | | | | | | | | | 1 | 2 |
| | | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | | | | | | | |

May

| | | | | | | | | | | | | |
|---|---|---|---|---|---|---|---|---|---|---|---|---|
| | | | | | | | 1 | 2 | 3 | 4 | 5 | 6 | 7 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

Jun

| | | | | | | | | | | | | |
|---|---|---|---|---|---|---|---|---|---|---|---|---|
| | | | | | | | | 1 | 2 | 3 | 4 | |
| | 1 | 2 | 3 | 4 | 5 | 6 | 7 | 8 | 9 | 10 | 11 | |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | | |
| 27 | 28 | 29 | 30 | | | | | | | | | |

| | | | | | | | | | | | | |
|---|---|---|---|---|---|---|---|---|---|---|---|---|
| | | | | | | | | | | | | 1 |
| | | | | | 1 | 2 | 3 | 4 | 5 | 6 | 7 | 8 |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| 24 | 25 | 26 | 27 | 28 | 29 | 30 | | | | | | |

| | | | | | | | | | | | | |
|---|---|---|---|---|---|---|---|---|---|---|---|---|
| | | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | 31 | | | |
| 29 | 30 | 31 | | | | | | | | | | |

| | | | | | | | | | | | | |
|---|---|---|---|---|---|---|---|---|---|---|---|---|
| | | | | | | | | | | 1 | 2 | 3 |
| | | | 1 | 2 | 3 | 4 | 5 | 6 | 7 | 8 | 9 | 10 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | |
| 26 | 27 | 28 | 29 | 30 | | | | | | | | |

Jul

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

Aug

| | | | | | | | | | | | | |
|---|---|---|---|---|---|---|---|---|---|---|---|---|
| | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | 31 | | | |
| 29 | 30 | 31 | | | | | | | | | | |

Sep

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | |
| 26 | 27 | 28 | 29 | 30 | | | | | | | | |

| | | | | | | | | | | | | |
|---|---|---|---|---|---|---|---|---|---|---|---|---|
| | | | | | | | | | | | | 1 |
| | | | | 1 | 2 | 3 | 4 | 5 | 6 | 7 | 8 | |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| 24 | 25 | 26 | 27 | 28 | 29 | 30 | 31 | | | | | |

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | 31 | | |
| 28 | 29 | 30 | 31 | | | | | | | | | |

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | | | | | | | |

Oct

| | | | | | | | | | | | | |
|---|---|---|---|---|---|---|---|---|---|---|---|---|
| | | | | | | | | | | | | 1 |
| | | | | 1 | 2 | 3 | 4 | 5 | 6 | 7 | 8 | |
| 3 | 4 | 5 | 6 | 7 | 8 | 9 | 10 | 11 | 12 | 13 | 14 | 15 |
| 10 | 11 | 12 | 13 | 14 | 15 | 16 | 17 | 18 | 19 | 20 | 21 | 22 |
| 17 | 18 | 19 | 20 | 21 | 22 | 23 | 24 | 25 | 26 | 27 | 28 | 29 |
| 24 | 25 | 26 | 27 | 28 | 29 | 30 | 31 | | | | | |
| 31 | | | | | | | | | | | | |

Nov

| | | | | | | | | | | | | |
|---|---|---|---|---|---|---|---|---|---|---|---|---|
| | | | | | | | | 1 | 2 | 3 | 4 | 5 |
| | 1 | 2 | 3 | 4 | 5 | 6 | 7 | 8 | 9 | 10 | 11 | 12 |
| 7 | 8 | 9 | 10 | 11 | 12 | 13 | 14 | 15 | 16 | 17 | 18 | 19 |
| 14 | 15 | 16 | 17 | 18 | 19 | 20 | 21 | 22 | 23 | 24 | 25 | 26 |
| 21 | 22 | 23 | 24 | 25 | 26 | 27 | 28 | 29 | 30 | | | |
| 28 | 29 | 30 | | | | | | | | | | |

Dec

| | | | | | | | | | | | | |
|---|---|---|---|---|---|---|---|---|---|---|---|---|
| | | | | | | | | | 1 | 2 | 3 | |
| | | | | 1 | 2 | 3 | 4 | 5 | 6 | 7 | 8 | 9 |
| 5 | 6 | 7 | 8 | 9 | 10 | 11 | 12 | 13 | 14 | 15 | 16 | 17 |
| 12 | 13 | 14 | 15 | 16 | 17 | 18 | 19 | 20 | 21 | 22 | 23 | 24 |
| 19 | 20 | 21 | 22 | 23 | 24 | 25 | 26 | 27 | 28 | 29 | 30 | 31 |
| 26 | 27 | 28 | 29 | 30 | 31 | | | | | | | |

| | | | | | | | | | | | | |
|---|---|---|---|---|---|---|---|---|---|---|---|---|
| | | | | | | | | | | | | |
| | | | | 1 | 2 | 3 | 4 | 5 | 6 | 7 | 8 | 9 |
| 2 | 3 | 4 | 5 | 6 | 7 | 8 | 9 | 10 | 11 | 12 | 13 | 14 |
| 9 | 10 | 11 | 12 | 13 | 14 | 15 | 16 | 17 | 18 | 19 | 20 | 21 |
| 16 | 17 | 18 | 19 | 20 | 21 | 22 | 23 | 24 | 25 | 26 | 27 | 28 |
| 23 | 24 | 25 | 26 | 27 | 28 | 29 | 30 | 31 | | | | |
| 30 | 31 | | | | | | | | | | | |

| | | | | | | | | | | | | |
|---|---|---|---|---|---|---|---|---|---|---|---|---|
| | | | | | | | | | 1 | 2 | 3 | 4 |
| | | 1 | 2 | 3 | 4 | 5 | 6 | 7 | 8 | 9 | 10 | 11 |
| 6 | 7 | 8 | 9 | 10 | 11 | 12 | 13 | 14 | 15 | 16 | 17 | 18 |
| 13 | 14 | 15 | 16 | 17 | 18 | 19 | 20 | 21 | 22 | 23 | 24 | 25 |
| 20 | 21 | 22 | 23 | 24 | 25 | 26 | 27 | 28 | 29 | 30 | | |
| 27 | 28 | 29 | 30 | | | | | | | | | |

| | | | | | | | | | | | | |
|---|---|---|---|---|---|---|---|---|---|---|---|---|
| | | | | | | | | | | | 1 | 2 |
| | | | | 1 | 2 | 3 | 4 | 5 | 6 | 7 | 8 | 9 |
| 4 | 5 | 6 | 7 | 8 | 9 | 10 | 11 | 12 | 13 | 14 | 15 | 16 |
| 11 | 12 | 13 | 14 | 15 | 16 | 17 | 18 | 19 | 20 | 21 | 22 | 23 |
| 18 | 19 | 20 | 21 | 22 | 23 | 24 | 25 | 26 | 27 | 28 | 29 | 30 |
| 25 | 26 | 27 | 28 | 29 | 30 | 31 | | | | | | |

Fig.6G-2

74 82 80

| | | | | | | | | | | | | | | | | | | | |
|---|---|---|---|---|---|---|---|---|---|---|---|---|---|---|---|---|---|---|---|
| 1. | 1 | 1589 | 1617 | 1645 | 1673 | | 1713 | 1741 | 1769 | 1797 | 1809 | 1837 | 1865 | 1893 | 1905 | 1933 | 1961 | 1989 | 2017 |
| 2. | 2 | 1590 | 1618 | 1646 | 1674 | | 1714 | 1742 | 1770 | 1798 | 1810 | 1838 | 1866 | 1894 | 1906 | 1934 | 1962 | 1990 | 2018 |
| 3. | 3 | 1591 | 1619 | 1647 | 1675 | | 1715 | 1743 | 1771 | 1799 | 1811 | 1839 | 1867 | 1895 | 1907 | 1935 | 1963 | 1991 | 2019 |
| 4. | 11 | 1592 | 1620 | 1648 | 1676 | | 1716 | 1744 | 1772 | xxxx | 1812 | 1840 | 1868 | 1896 | 1908 | 1936 | 1964 | 1992 | 2020 |
| 5. | 6 | 1593 | 1621 | 1649 | 1677 | 1700 | 1717 | 1745 | 1773 | | 1813 | 1841 | 1869 | 1897 | 1909 | 1937 | 1965 | 1993 | 2021 |
| 6. | 7 | 1594 | 1622 | 1650 | 1678 | | 1718 | 1746 | 1774 | | 1814 | 1842 | 1870 | 1898 | 1910 | 1938 | 1966 | 1994 | 2022 |
| 7. | 1 | 1595 | 1623 | 1651 | 1679 | | 1719 | 1747 | 1775 | | 1815 | 1843 | 1871 | 1899 | 1911 | 1939 | 1967 | 1995 | 2023 |
| 8. | 9 | 1596 | 1624 | 1652 | 1680 | | 1720 | 1748 | 1776 | | 1816 | 1844 | 1872 | xxxx | 1912 | 1940 | 1968 | 1996 | 2024 |
| 9. | 4 | 1597 | 1625 | 1653 | 1681 | | 1721 | 1749 | 1777 | 1800 | 1817 | 1845 | 1873 | | 1913 | 1941 | 1969 | 1997 | 2025 |
| 10. | 5 | 1598 | 1626 | 1654 | 1682 | | 1722 | 1750 | 1778 | | 1818 | 1846 | 1874 | | 1914 | 1942 | 1970 | 1998 | 2026 |
| 11. | 6 | 1599 | 1627 | 1655 | 1683 | 1700 | 1723 | 1751 | 1779 | | 1819 | 1847 | 1875 | | 1915 | 1943 | 1971 | 1999 | 2027 |
| 12. | 14 | 1600 | 1628 | 1656 | 1684 | | 1724 | 1752 | 1780 | | 1820 | 1848 | 1876 | | 1916 | 1944 | 1972 | 2000 | 2028 |
| 13. | 2 | 1601 | 1629 | 1657 | 1685 | | 1725 | 1753 | 1781 | | 1821 | 1849 | 1877 | 1900 | 1917 | 1945 | 1973 | 2001 | 2029 |
| 14. | 3 | 1602 | 1630 | 1658 | 1686 | | 1726 | 1754 | 1782 | | 1822 | 1850 | 1878 | | 1918 | 1946 | 1974 | 2002 | 2030 |
| 15. | 4 | 1603 | 1631 | 1659 | 1687 | | 1727 | 1755 | 1783 | 1800 | 1823 | 1851 | 1879 | | 1919 | 1947 | 1975 | 2003 | 2031 |
| 16. | 12 | 1604 | 1632 | 1660 | 1688 | | 1728 | 1756 | 1784 | | 1824 | 1852 | 1880 | | 1920 | 1948 | 1976 | 2004 | 2032 |
| 17. | 7 | 1605 | 1633 | 1661 | 1689 | 1701 | 1729 | 1757 | 1785 | | 1825 | 1853 | 1881 | | 1921 | 1949 | 1977 | 2005 | 2033 |
| 18. | 1 | 1606 | 1634 | 1662 | 1690 | 1702 | 1730 | 1758 | 1786 | | 1826 | 1854 | 1882 | | 1922 | 1950 | 1978 | 2006 | 2034 |
| 19. | 2 | 1607 | 1635 | 1663 | 1691 | 1703 | 1731 | 1759 | 1787 | | 1827 | 1855 | 1883 | 1900 | 1923 | 1951 | 1979 | 2007 | 2035 |
| 20. | 10 | 1608 | 1636 | 1664 | 1692 | 1704 | 1732 | 1760 | 1788 | | 1828 | 1856 | 1884 | | 1924 | 1952 | 1980 | 2008 | 2036 |
| 21. | 5 | 1609 | 1637 | 1665 | 1693 | 1705 | 1733 | 1761 | 1789 | 1801 | 1829 | 1857 | 1885 | | 1925 | 1953 | 1981 | 2009 | 2037 |
| 22. | 6 | 1610 | 1638 | 1666 | 1694 | 1706 | 1734 | 1762 | 1790 | 1802 | 1830 | 1858 | 1886 | | 1926 | 1954 | 1982 | 2010 | 2038 |
| 23. | 7 | 1611 | 1639 | 1667 | 1695 | 1707 | 1735 | 1763 | 1791 | 1803 | 1831 | 1859 | 1887 | | 1927 | 1955 | 1983 | 2011 | 2039 |
| 24. | 8 | 1612 | 1640 | 1668 | 1696 | 1708 | 1736 | 1764 | 1792 | 1804 | 1832 | 1860 | 1888 | | 1928 | 1956 | 1984 | 2012 | 2040 |
| 25. | 3 | 1613 | 1641 | 1669 | 1697 | 1709 | 1737 | 1765 | 1793 | 1805 | 1833 | 1861 | 1889 | 1901 | 1929 | 1957 | 1985 | 2013 | 2041 |
| 26. | 4 | 1614 | 1642 | 1670 | 1698 | 1710 | 1738 | 1766 | 1794 | 1806 | 1834 | 1862 | 1890 | 1902 | 1930 | 1958 | 1986 | 2014 | 2042 |
| 27. | 5 | 1615 | 1643 | 1671 | 1699 | 1711 | 1739 | 1767 | 1795 | 1807 | 1835 | 1863 | 1891 | 1903 | 1931 | 1959 | 1987 | 2015 | 2043 |
| 28. | 13 | 1616 | 1644 | 1672 | xxxx | 1712 | 1740 | 1768 | 1796 | 1808 | 1836 | 1864 | 1892 | 1904 | 1932 | 1960 | 1988 | 2016 | 2044 |

FIG. 7A

| | | | | | | | | | | | | | | | | | | | |
|---|---|---|---|---|---|---|---|---|---|---|---|---|---|---|---|---|---|---|---|
| 1. | 1 | 2045 | 2073 | | 2113 | 2141 | 2169 | 2197 | 2209 | 2237 | 2265 | 2293 | 2305 | 2333 | 2361 | 2389 | 2417 | 2445 | 2473 |
| 2. | 2 | 2046 | 2074 | | 2114 | 2142 | 2170 | 2198 | 2210 | 2238 | 2266 | 2294 | 2306 | 2334 | 2362 | 2390 | 2418 | 2446 | 2474 |
| 3. | 3 | 2047 | 2075 | | 2115 | 2143 | 2171 | 2199 | 2211 | 2239 | 2267 | 2295 | 2307 | 2335 | 2363 | 2391 | 2419 | 2447 | 2475 |
| 4. | 11 | 2048 | 2076 | | 2116 | 2144 | 2172 | xxxx | 2212 | 2240 | 2268 | 2296 | 2308 | 2336 | 2364 | 2392 | 2420 | 2448 | 2476 |
| 5. | 6 | 2049 | 2077 | 2100 | 2117 | 2145 | 2173 | | 2213 | 2241 | 2269 | 2297 | 2309 | 2337 | 2365 | 2393 | 2421 | 2449 | 2477 |
| 6. | 7 | 2050 | 2078 | | 2118 | 2146 | 2174 | | 2214 | 2242 | 2270 | 2298 | 2310 | 2338 | 2366 | 2394 | 2422 | 2450 | 2478 |
| 7. | 1 | 2051 | 2079 | | 2119 | 2147 | 2175 | | 2215 | 2243 | 2271 | 2299 | 2311 | 2339 | 2367 | 2395 | 2423 | 2451 | 2479 |
| 8. | 9 | 2052 | 2080 | | 2120 | 2148 | 2176 | | 2216 | 2244 | 2272 | xxxx | 2312 | 2340 | 2368 | 2396 | 2424 | 2452 | 2480 |
| 9. | 4 | 2053 | 2081 | | 2121 | 2149 | 2177 | 2200 | 2217 | 2245 | 2273 | | 2313 | 2341 | 2369 | 2397 | 2425 | 2453 | 2481 |
| 10. | 5 | 2054 | 2082 | | 2122 | 2150 | 2178 | | 2218 | 2246 | 2274 | | 2314 | 2342 | 2370 | 2398 | 2426 | 2454 | 2482 |
| 11. | 6 | 2055 | 2083 | 2100 | 2123 | 2151 | 2179 | | 2219 | 2247 | 2275 | | 2315 | 2343 | 2371 | 2399 | 2427 | 2455 | 2483 |
| 12. | 14 | 2056 | 2084 | | 2124 | 2152 | 2180 | | 2220 | 2248 | 2276 | | 2316 | 2344 | 2372 | 2400 | 2428 | 2456 | 2484 |
| 13. | 2 | 2057 | 2085 | | 2125 | 2153 | 2181 | | 2221 | 2249 | 2277 | 2300 | 2317 | 2345 | 2373 | 2401 | 2429 | 2457 | 2485 |
| 14. | 3 | 2058 | 2086 | | 2126 | 2154 | 2182 | | 2222 | 2250 | 2278 | | 2318 | 2346 | 2374 | 2402 | 2430 | 2458 | 2486 |
| 15. | 4 | 2059 | 2087 | | 2127 | 2155 | 2183 | 2200 | 2223 | 2251 | 2279 | | 2319 | 2347 | 2375 | 2403 | 2431 | 2459 | 2487 |
| 16. | 12 | 2060 | 2088 | | 2128 | 2156 | 2184 | | 2224 | 2252 | 2280 | | 2320 | 2348 | 2376 | 2404 | 2432 | 2460 | 2488 |
| 17. | 7 | 2061 | 2089 | 2101 | 2129 | 2157 | 2185 | | 2225 | 2253 | 2281 | | 2321 | 2349 | 2377 | 2405 | 2433 | 2461 | 2489 |
| 18. | 1 | 2062 | 2090 | 2102 | 2130 | 2158 | 2186 | | 2226 | 2254 | 2282 | | 2322 | 2350 | 2378 | 2406 | 2434 | 2462 | 2490 |
| 19. | 2 | 2063 | 2091 | 2103 | 2131 | 2159 | 2187 | | 2227 | 2255 | 2283 | 2300 | 2323 | 2351 | 2379 | 2407 | 2435 | 2463 | 2491 |
| 20. | 10 | 2064 | 2092 | 2104 | 2132 | 2160 | 2188 | | 2228 | 2256 | 2284 | | 2324 | 2352 | 2380 | 2408 | 2436 | 2464 | 2492 |
| 21. | 5 | 2065 | 2093 | 2105 | 2133 | 2161 | 2189 | 2201 | 2229 | 2257 | 2285 | | 2325 | 2353 | 2381 | 2409 | 2437 | 2465 | 2493 |
| 22. | 6 | 2066 | 2094 | 2106 | 2134 | 2162 | 2190 | 2202 | 2230 | 2258 | 2286 | | 2326 | 2354 | 2382 | 2410 | 2438 | 2466 | 2494 |
| 23. | 7 | 2067 | 2095 | 2107 | 2135 | 2163 | 2191 | 2203 | 2231 | 2259 | 2287 | | 2327 | 2355 | 2383 | 2411 | 2439 | 2467 | 2495 |
| 24. | 8 | 2068 | 2096 | 2108 | 2136 | 2164 | 2192 | 2204 | 2232 | 2260 | 2288 | | 2328 | 2356 | 2384 | 2412 | 2440 | 2468 | 2496 |
| 25. | 3 | 2069 | 2097 | 2109 | 2137 | 2165 | 2193 | 2205 | 2233 | 2261 | 2289 | 2301 | 2329 | 2357 | 2385 | 2413 | 2441 | 2469 | 2497 |
| 26. | 4 | 2070 | 2098 | 2110 | 2138 | 2166 | 2194 | 2206 | 2234 | 2262 | 2290 | 2302 | 2330 | 2358 | 2386 | 2414 | 2442 | 2470 | 2498 |
| 27. | 5 | 2071 | 2099 | 2111 | 2139 | 2167 | 2195 | 2207 | 2235 | 2263 | 2291 | 2303 | 2331 | 2359 | 2387 | 2415 | 2443 | 2471 | 2499 |
| 28. | 13 | 2072 | xxxx | 2112 | 2140 | 2168 | 2196 | 2208 | 2236 | 2264 | 2292 | 2304 | 2332 | 2360 | 2388 | 2416 | 2444 | 2472 | xxxx |

FIG. 7B

PERPETUAL CALENDAR

FIELD OF THE INVENTION

The present invention generally relates to calendars and more particularly relates to a perpetual calendar that can be adjusted to display the days of all twelve months in any year.

BACKGROUND OF THE INVENTION

Perpetual calendars have been devised in the past to provide time records of the days of the months of any year, as opposed to calendars that display the days of only one particular month or year. Such calendars typically include a number grid that is selectively positioned behind one or more windows through which the days of certain months are displayed. The number grid can be repositioned relative to the window or windows to display days in different months of different years. Two examples of perpetual calendars are disclosed in the following U.S. patents: U.S. Pat. No. 1,949,328 to Pinkerton; and U.S. Pat. No. 3,427,740 to Heskes.

The patent to Pinkerton discloses a perpetual calendar that is the size and shape of a business card, and is designed to be used as such. This calendar includes only one window through which the number grid can be viewed and therefore displays only one month at a time. The number grid is slid back and forth horizontally behind the window in an outer sleeve-like container, which includes the window on one side. Next to the window on the outside of the container are various characters and legends that must be deciphered to determine the month and year of the calendar month displayed in the window.

While the Pinkerton calendar is advantageous because of its small size, it has several disadvantages. First, it only displays one month at a time. Also, the month of the year being displayed is not clearly indicated on the container, but must be deciphered using a rather complex table that occupies more space on the device than the calendar window itself. In addition, the proper position of the number grid relative to the window is only determined after deciphering the complex table printed on the container. In short, the Pinkerton calendar is too complex for simple reference, because it requires time-consuming and difficult decoding steps to make use of the device. Another disadvantage is that because there is only one number grid provided, shorter months such as February appear to have more days than that particular month actually has due to the attempt at using a single number grid for all twelve months. Still another disadvantage is that there is nothing to hold the grid in one position within the container. The grid is free to slide in and out of the container, possibly resulting in its loss, and at least requiring repositioning every time a user refers to the Pinkerton calendar.

The patent to Heskes discloses a perpetual calendar that also includes a number grid in the form of a slide that is slid horizontally back and forth inside a sleeve. The sleeve includes seven display windows, each of which simultaneously corresponds to at least one month. Two of the windows may display up to three months at a time. The seven windows are shown arranged horizontally, side by side, in one embodiment and in three tiers in another embodiment. The sleeve also includes century and year slots to permit the selection of any one year calendar in any of a plurality of centuries. The slide includes an arrangement of sixty-one vertical columns of daily dates consisting of rows of dates running from 1 to 31. In any position within the sleeve, forty-nine of the date rows are displayed in the seven windows. The remaining rows are hidden behind sections of the sleeve between the windows. The slide also includes century and year indicators, which are visible in the century and year slots in the sleeve to indicate the calendar year being displayed.

The Heskes calendar is advantageous over the Pinkerton calendar because it required no deciphering of a table to determine which month and year is being displayed. However, the Heskes calendar is still disadvantageous because it displays twelve months in seven windows. Using one window to display more than one month creates an unnatural appearing calendar, which is not as easily used as a conventional twelve month calendar. In addition, the months are arranged out of their natural sequential order among the seven windows. Another problem, which is also present in the Pinkerton calendar, is that the Heskes calendar assumes the user will know the number of days in each month. For example, the fourth month of the Heskes calendar displays the dates in the months of February, March, and November. However, all three of these months have a different number of days. Other problems with the Heskes calendar include the same as those with the Pinkerton calendar, such as the lack of any provision to hold the slide fixed in one spot within the sleeve.

Thus, there remains a need for a new and improved perpetual calendar that is adjustable to permit the days of the months of any year to be displayed, while at the same time having the appearance of a conventional single-year calendar to avoid the possibility of errors and confusion when reading the perpetual calendar.

OBJECTS AND SUMMARY OF THE INVENTION

In view of the above, an object of the present invention is to provide a perpetual calendar that includes twelve month-windows for simultaneously and individually displaying all twelve months of any chosen year similarly to a conventional single-year calendar.

Another object of the present invention is to provide a perpetual calendar that, once the calendar is set up for a particular year, requires no calculations to determine the dates being displayed.

A further object of the present invention is to provide a perpetual calendar that displays leap years in the same manner as common years, requiring no special calculations or steps for leap years.

Another object of the present invention is to provide a perpetual calendar that displays the correct number of days in each month.

Still a further object of the present invention is to provide a perpetual calendar that includes a positioning apparatus that permits easy reorientation of the calendar to different yearly positions, yet also securely holds the calendar in place in a chosen yearly position so that it cannot be accidentally disturbed and repositioned in an erroneous yearly position.

The present invention achieves these and other objects by providing a perpetual calendar that simultaneously and individually displays all twelve months of any predetermined year. The perpetual calendar generally comprises three main subcomponents: an outer housing sleeve having twelve month-windows, a middle panel movably disposed inside the outer housing sleeve, and a numerical calendar grid adorning the face of the middle panel behind the month-windows. The preferred embodiment of the perpetual calendar also includes positioning means for orienting the middle panel and therefore the calendar grid in particular yearly positions, as well as indicia for displaying the current yearly position in which the calendar is oriented.

More particularly, the outer housing sleeve of the preferred embodiment includes a generally planar front panel that includes twelve cut-out month-windows separated by intervening portions. Month-indicia adorn the front face of the front panel adjacent the month-windows to designate each of the twelve months. A generally planar back panel is joined around a periphery thereof to a periphery of the front panel to define a space between the front and back panels. The twelve month-windows in the front panel may be arranged in any configuration commonly used for single-year calendars. For example, the month-windows may be arranged in columns and rows or in a straight line or in a circle.

In the preferred embodiment, the middle panel is movably disposed in the space between the front and back panels. As is commonly known, there are fourteen possible configurations for a yearly calendar: seven for leap years and seven for common years. Therefore, the middle panel may be oriented among fourteen distinct yearly positions.

The calendar grid adorns a front face of the middle panel behind the month-windows and includes twelve month-grids for simultaneously displaying the dates of all twelve months of any year individually in the month-windows. In the preferred embodiment, each of the month-grids includes a common year grid movable among seven common year positions and a leap year grid movable among seven leap year positions. Preferably, the leap year grid and common year grid are disposed adjacent to one another so that the same month-window can be used for either, depending on the type of year. The disposition of the common and leap year grids relative to one another depends on the chosen configuration of the month-windows. In any case, during a common year, a selected section of the common year grid is displayed in a respective one of the month-windows while the remainder of the common year grid as well as the entire leap year grid are hidden from view behind an adjacent intervening portion of the front panel. During a leap year, a selected section of the leap year grid is displayed in the respective month-window while the remainder of the leap year grid as well as the entire common year grid are hidden from view behind an intervening portion of the front panel. In the preferred embodiment of the invention, each of the twelve month-grids is configured to display only a single selected month of the year and to display the precise number of days in the selected month.

The positioning means orients the middle panel in one of the fourteen yearly positions according to calculated yearly chronology, thereby resulting in the twelve month-grids being oriented in the month-windows in such a manner as to display the dates of a predetermined year. In the preferred embodiment, the positioning means includes two generally C-shaped slots in the back panel of the housing sleeve. Each C-shaped slot includes upper and lower horizontal portions that each include seven distinct yearly position demarcations and yearly position indicia. Each C-shaped slot also includes a connecting portion that communicatively connects the upper and lower horizontal portions. The positioning means further includes two elongated positioning members protruding from the back face of the middle panel through respective C-shaped slots. The positioning members are movable between the upper and lower horizontal portions of the C-shaped slots through the connecting portions and cooperate with the yearly position demarcations to position the middle panel in the yearly positions. In addition, the positioning members may include locking devices for securing the middle panel in a fixed yearly position to prevent accidental reorientation of the month-grids in the month-windows.

To display the yearly position in which the calendar is currently oriented, position indicia are provided, which preferably includes at least one set of fourteen position numbers adorning the middle panel that correspond to the fourteen yearly positions. To display individual position numbers that correspond to particular yearly positions, at least one position number window is provided in the outer housing sleeve. Preferably, each set of position numbers includes two adjacent rows of seven position numbers each, one row including position numbers for yearly positions of common years, the other row including position numbers for yearly positions of leap years. Like the common and leap year grids on the middle panel, the relative disposition of the position numbers depends on the configuration of the month-windows.

The perpetual calendar of the invention may also include a chart on the outer housing sleeve for enabling determination of the yearly position of the middle panel required to orient the month-grids so that they display a certain year. The yearly position is determined by corresponding calendar years to the fourteen yearly position indicators.

Other aspects and advantages of the present invention will become apparent and obvious from a study of the following description and the accompanying drawings, which are merely illustrative of the invention.

BRIEF DESCRIPTION OF THE DRAWINGS

FIGS. 6A–6G are seven variations of the numerical calendar grid that adorns the front face of the middle panel, any of which may be used with the perpetual calendar of the invention.

FIG. 7 is a chart that is used to determine the yearly position of the middle panel required to orient the month-grids so that they display a certain calendar year. The chart of FIG. 7 is for use with the calendar grid shown in FIG. 6B.

DETAILED DESCRIPTION OF THE INVENTION

Figure 1:
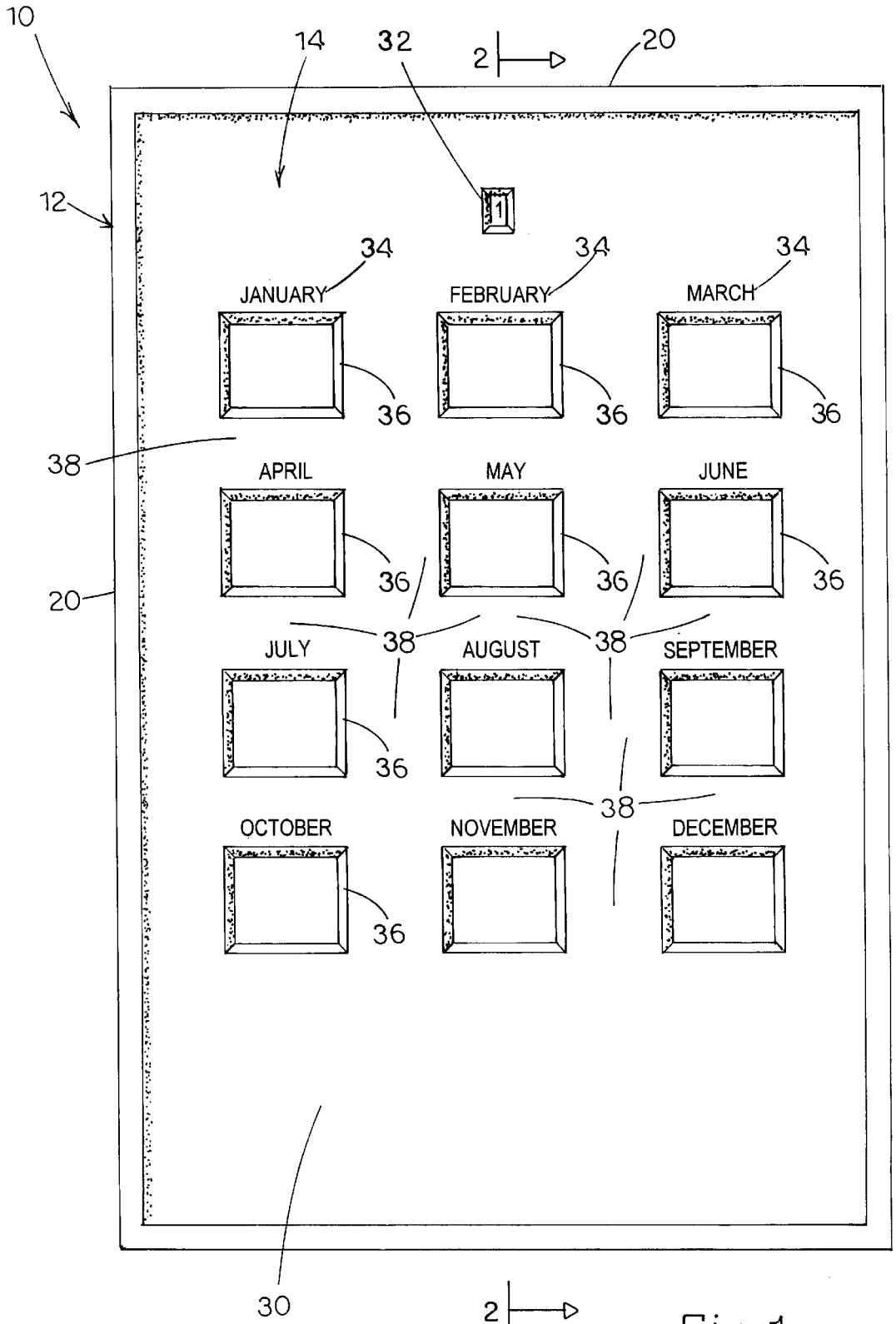
FIG. 1 is a depiction of the front face of the perpetual calendar of the present invention, which shows the twelve month-windows and a position number window.

The present invention is described more fully hereinafter by referring to the drawings, in which a preferred embodiment is depicted. However, the present invention can take on many different embodiments and is not intended to be limited to the embodiments described herein.

Referring now to the drawings in general and FIG. 1 in particular, a perpetual calendar, generally designated 10, is shown constructed according to the present invention for simultaneously and individually displaying all twelve months of any year. As seen in the rest of the drawings, the perpetual calendar 10 generally includes three main sub-components: an outer housing sleeve 12 having twelve month-windows, a middle panel 60 movably disposed inside the outer housing sleeve, and a numerical calendar grid generally designated with the numeral 70 on the front face of the middle panel behind the month-windows.

Figure 2:
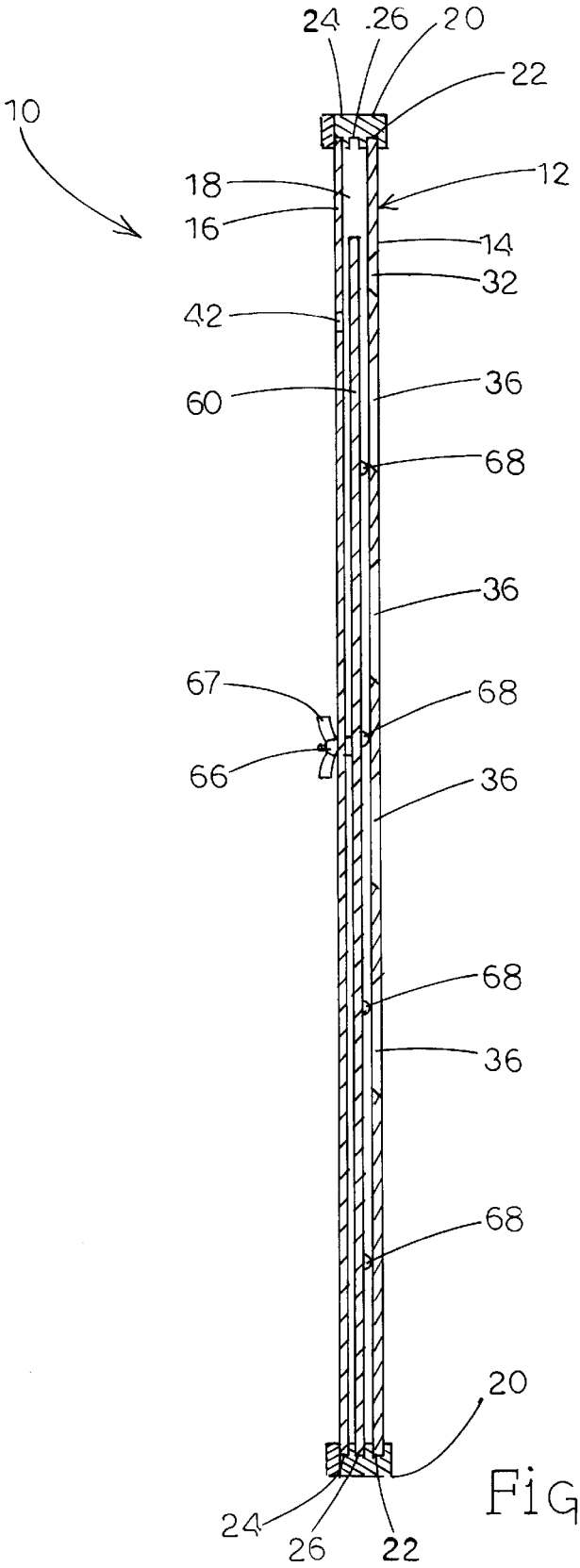
FIG. 2 is a cross-sectional depiction of the perpetual calendar of the present invention, taken along lines 2—2 of FIG. 1, which shows the disposition of the movable middle panel inside the space between the front and back panels.

In the preferred embodiment, the outer housing sleeve 12 includes a generally planar front panel 14 and a generally planar back panel 16, which together define a space 18 therebetween. The front and back panels 14, 16 are joined around their peripheries so that the space 18 is substantially enclosed around all sides. To separate the front panel 14 from the back panel 16 to define the space therebetween, a peripheral spacing member 20 is preferably provided, which may include a length of molding extending around the exterior periphery of the outer housing sleeve 12. As seen in FIG. 2, the exterior molding 20 may include a front panel slot 22 in which is disposed the front panel 14, a back panel slot 24 in which is disposed the back panel 16, and a middle panel slot 26 in which the middle panel 60 may be received. The front and back panels 14, 16 are preferably securely affixed in the respective front and back slots 22, 24. However, the middle panel 60 is preferably movable up-and-down and side-to-side within the housing sleeve, as will be explained later, and therefore is not affixed but is movable within the middle slot 26.

As shown in FIG. 1, the front panel 14 includes twelve cut-outs that function as month-windows 36, which are separated by intervening portions 38 of the front panel 14. Month-indicia 34 preferably adorn the front face 30 of the front panel 14 adjacent the month-windows 36 to designate each of the twelve calendar months of the year from January to December. The twelve month-windows 36 may be arranged in the front panel 14 in any configuration commonly used for single-year calendars. For example, the month-windows may be arranged in columns and rows or in a straight line or in a circular fashion. Most commonly, single-year calendars are arranged in columns and rows; therefore, the preferred embodiment of the perpetual calendar 10 of the invention is shown having the month-windows 36 arranged in three columns×four rows. It is also contemplated that the month-windows 36 could just as easily be arranged in any of the following configurations: four columns×three rows; two columns×six rows; six columns×two rows; one column×twelve rows; or twelve columns×one row.

As mentioned above, the middle panel 60 is movably disposed in the enclosed space 18 between the front and back panels 14, 16. As is commonly known, there are fourteen possible configurations for a yearly calendar: seven for leap years and seven for common years. This is because there are seven days of the week on which a year may begin. Therefore, the middle panel 60 is designed to be oriented among fourteen distinct yearly positions. As shown in FIG. 2, the middle panel 60 is shorter than the front and back panels 14, 16. This is so the middle panel 60 can be slid up and down within the space 18. When the middle panel 60 is slid upwardly, it may be received in the middle slot 26 at the top of the housing sleeve 12. When the middle panel 60 is slid downwardly, it may be received in the middle slot 26 at the bottom of the housing sleeve 12, as it is shown in FIG. 2. Preferably, the middle panel 60 includes spacers 68 extending from a front face 62 thereof for reducing friction between the middle panel 60 and the outer housing sleeve 12 as the middle panel 60 is moved within the space 18. Optionally, the middle panel may also include spacers (not shown) protruding from a back face 64 of the middle panel 60.

Figure 4:
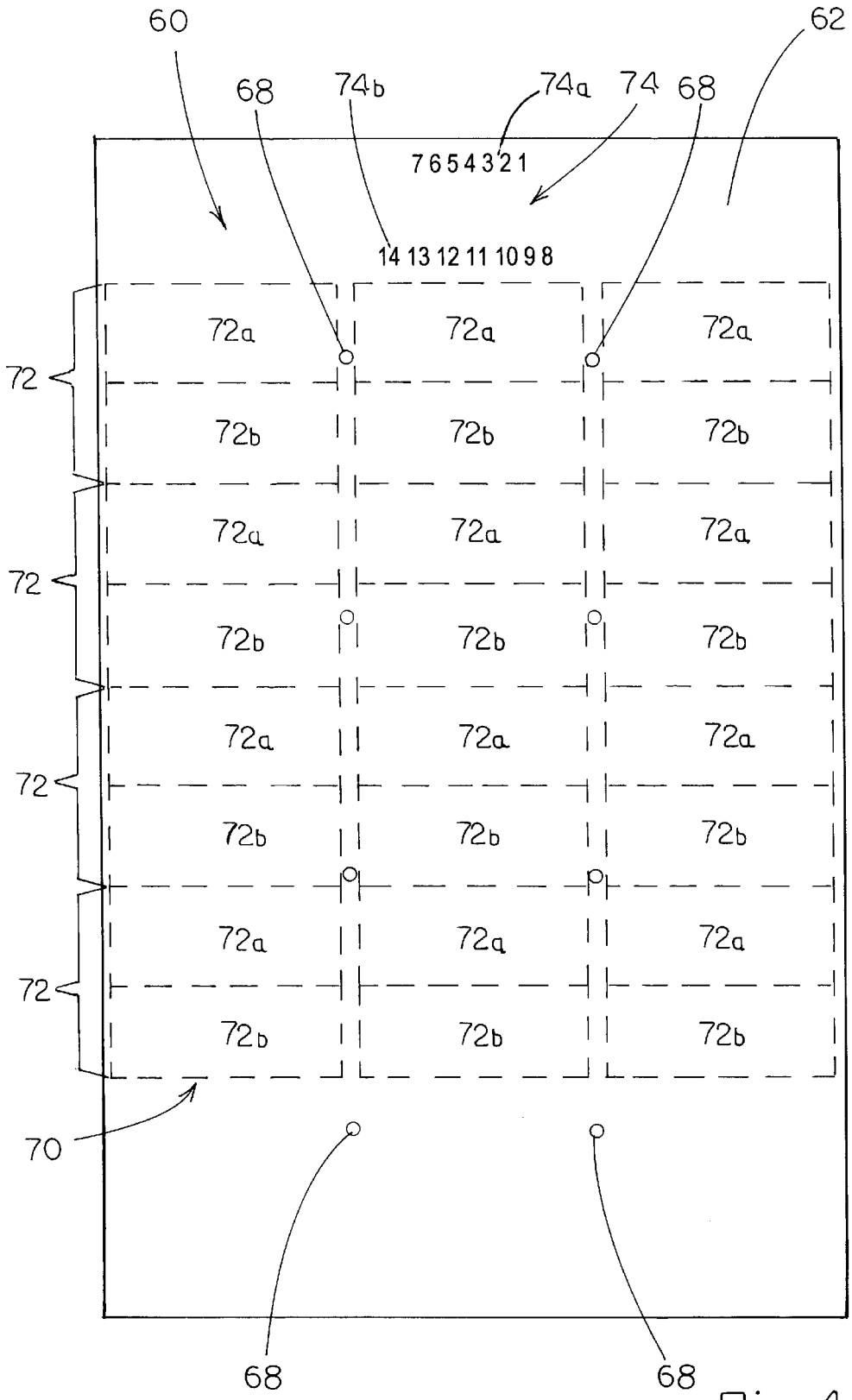
FIG. 4 is a representation of a calendar grid on the front face of the middle panel of the perpetual calendar, here shown schematically without numbers to illustrate the relationships of the twelve month-grids. Also seen is the yearly position indicia, which includes fourteen position numbers on the front face of the middle panel above the month-grids.

Referring now to FIG. 4 and FIGS. 6A–6G, the calendar grid 70 adorns the front face 62 of the middle panel 60 (shown in FIG. 4 removed from the housing sleeve 12) and includes twelve month-grids 72 for simultaneously displaying the dates of all twelve months of any year individually in the month-windows 36 of the housing sleeve 12. In the preferred embodiment, each of the month-grids 72 includes a common year grid 72*a* movable among seven common year positions and a leap year grid 72*b* movable among seven leap year positions. In FIG. 4, the daily date numerals are omitted from the month-grids 72 for clarity while FIGS. 6A–6G include the daily date numerals on the depicted calendar grids 70*a*–70*g*.

Preferably, the leap year grid 72*b* and common year grid 72*a* are disposed adjacent to one another so that the same month-window 36 can be used for either, depending on the type of year. The disposition of the common and leap year grids 72*a,b* relative to one another depends on the chosen configuration of the month-windows 36. In the embodiment shown, where there are three columns and twelve rows of month-windows 36, the common year and leap year grids 72*a,b* are arranged one above the other in a vertical relationship. With a different style of calendar, the common year and leap year grids 72*a,b* could be arranged one beside the other in a horizontal relationship. In any case, during a common year, a selected section of the common year grid 72*a* is displayed in a respective one of the month-windows 36 while the remainder of the common year grid 72*a* as well as the entire leap year grid 72*b* are hidden from view behind an adjacent intervening portion 38 of the front panel 14. During a leap year, a selected section of the leap year grid 72*b* is displayed in the respective month-window 36 while the remainder of the leap year grid 72*b* as well as the entire common year grid 72*a* are hidden from view behind an intervening portion 38.

In the preferred embodiment of the invention, each of the twelve month-grids 72 is configured to display only a single selected month in its own month-window 36 and to display the precise number of days in the selected month. This is shown most clearly by reference to one of the calendar grids shown in FIGS. 6A–6G. While generally referred to with the numeral 70, the calendar grid may have any of seven different configurations, which are numbered 70*a*–70*g* in FIGS. 6A–6G, respectively. Any of these grids 70*a–g* may be used with the perpetual calendar of the invention. In these grids 70*a*–70*g*, the month indicia (January–December) above each month-grid 72 are shown primarily for clarity in this description, but are not necessary included in the actual embodiment of the perpetual calendar 10 of the invention owing to the presence of month indicia 34 on the front face 30 of the front panel 14. Using grid 70*b* shown in FIG. 6B as an example, it can be seen that each of the month-grids 72 include only up to the number of days that are in that particular month; i.e., 31 days for January, March, May, July, August, October, and December; and 30 days for April, June, September, and November. As for February, common year grid 72*a* includes up to number 28; whereas, leap year grid 72*b* includes up to number 29.

Figures 1, 6A:
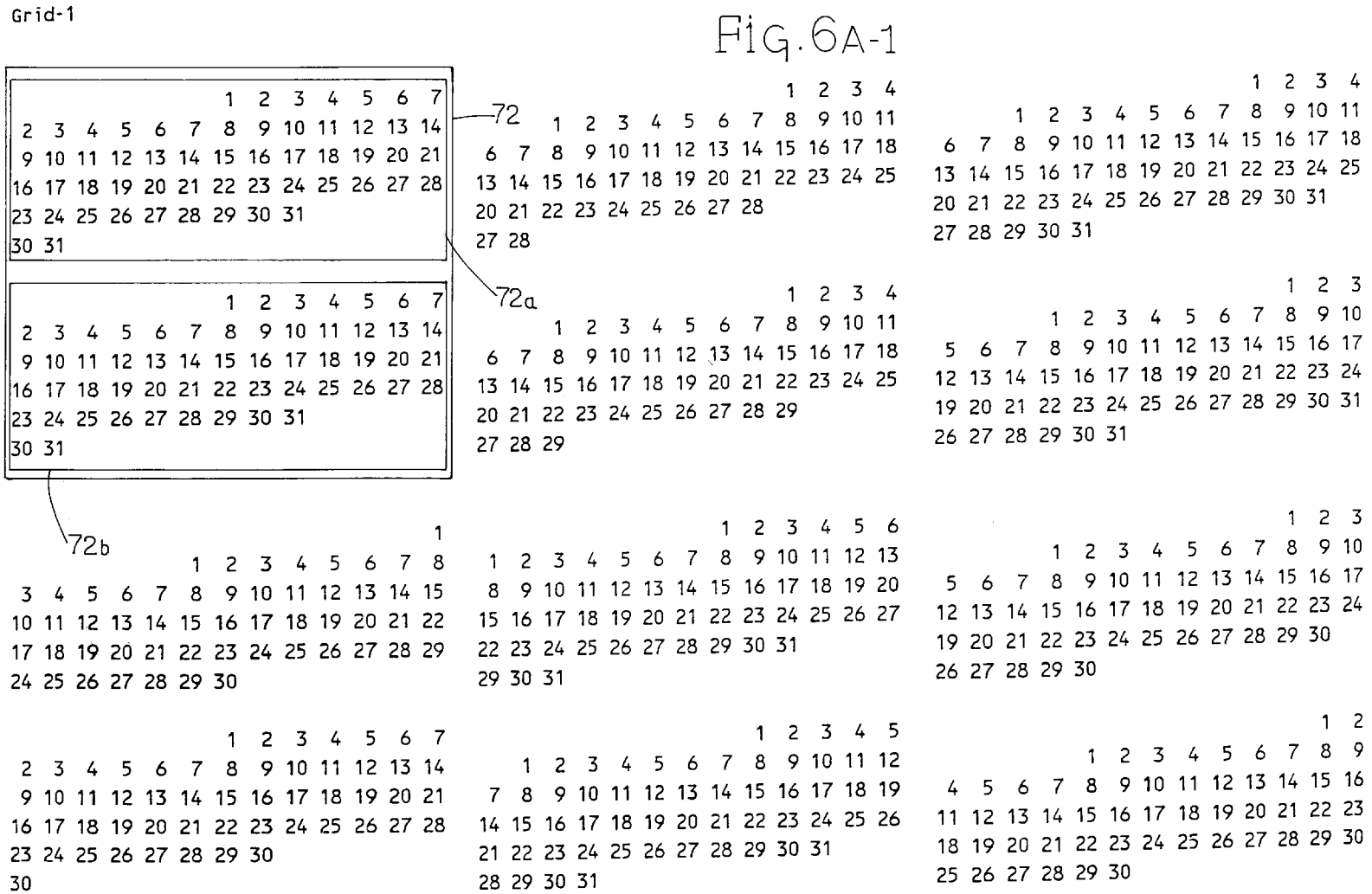
Figures 1, 6B:
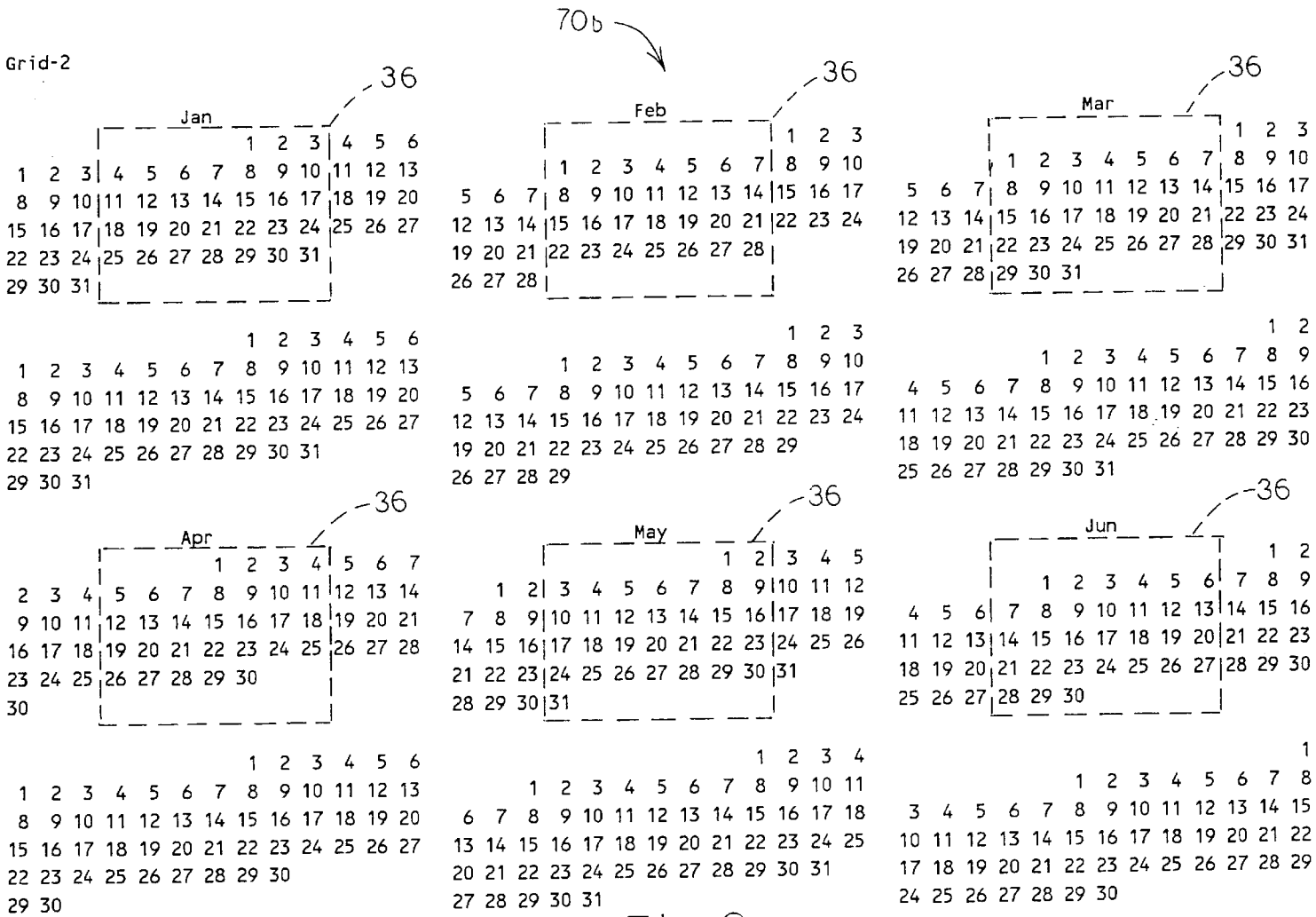
Figures 2, 6B:
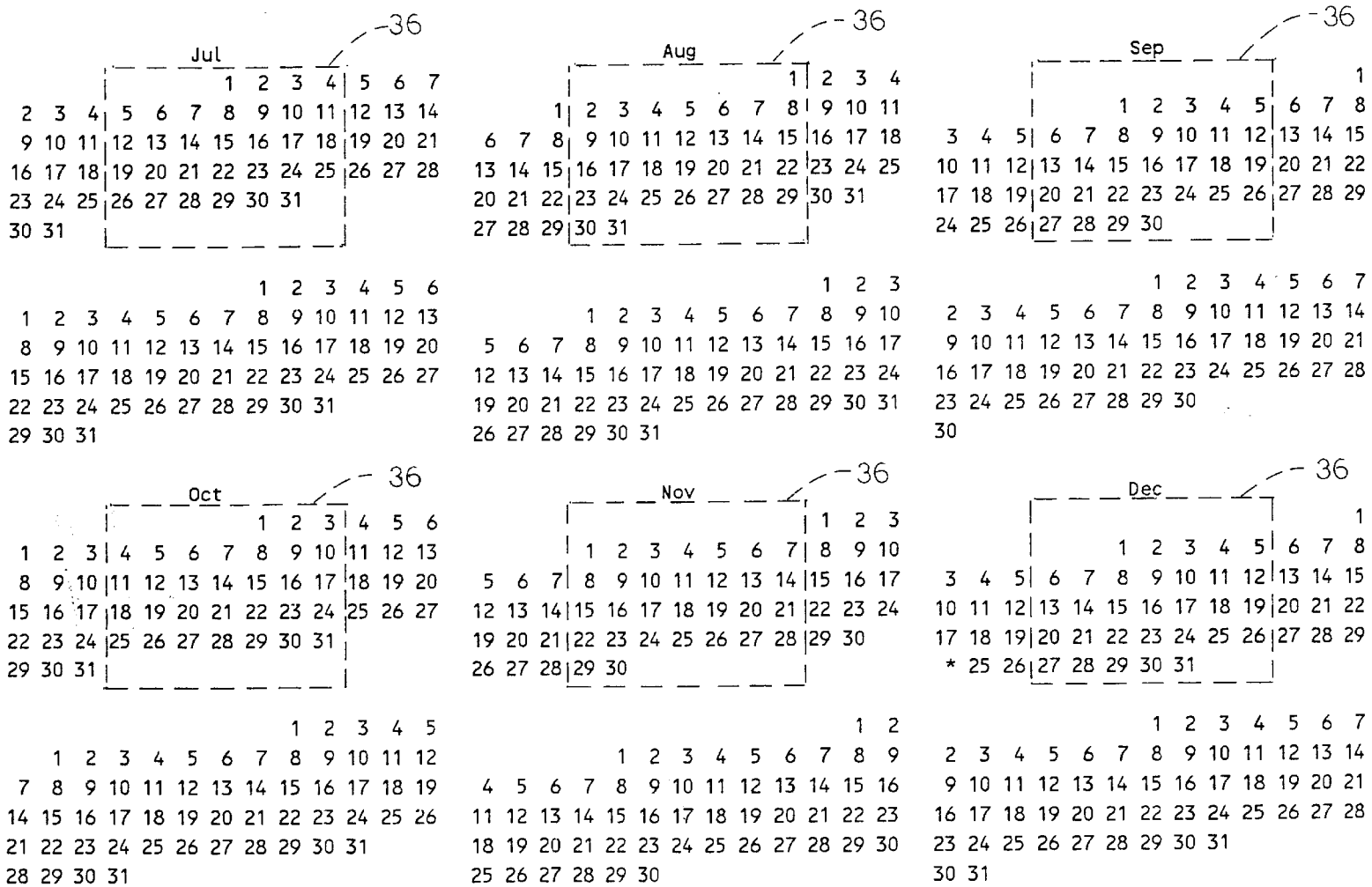
Figures 1, 6C:
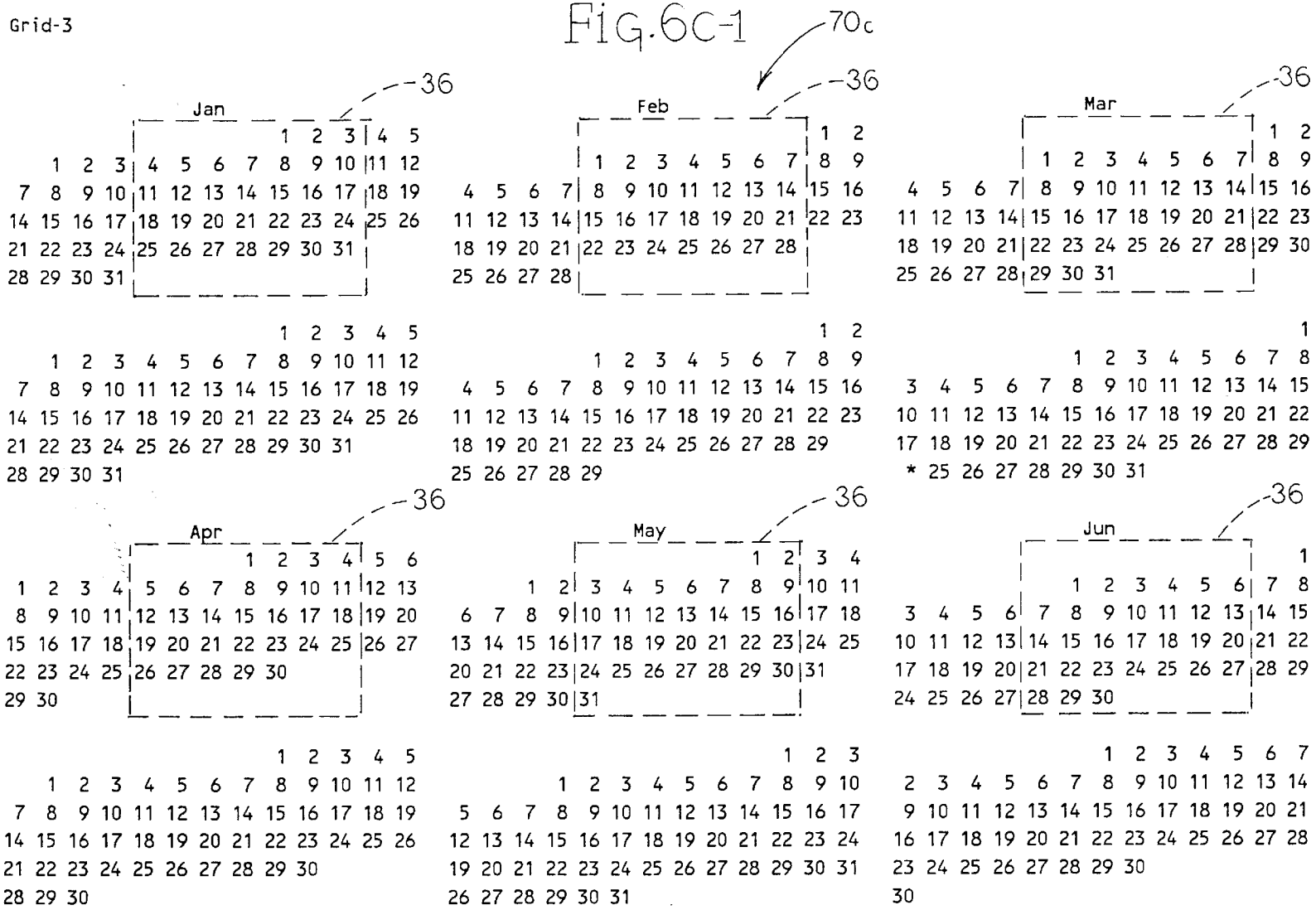
Figures 2, 6C:
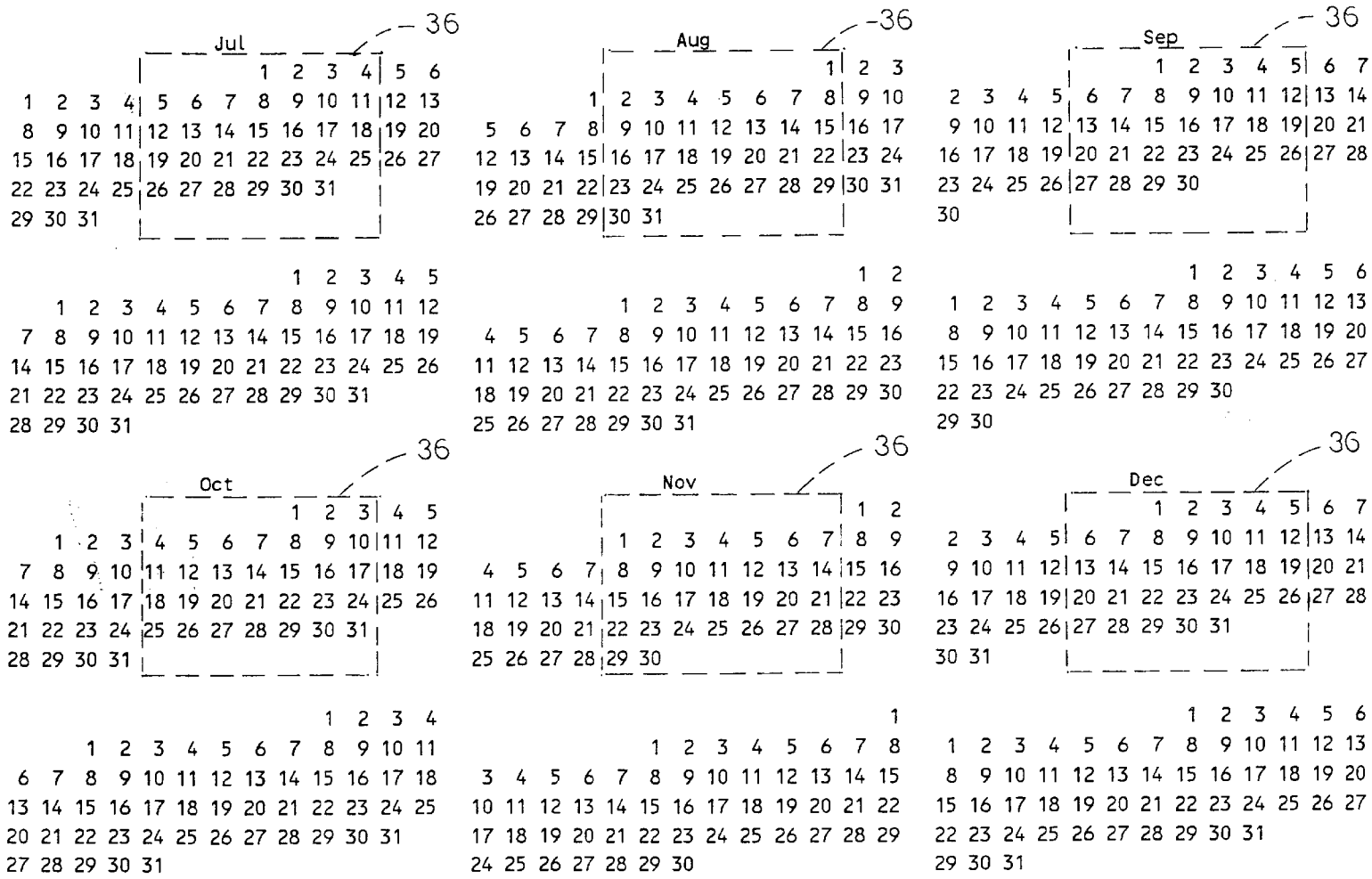
Figures 1, 6D:
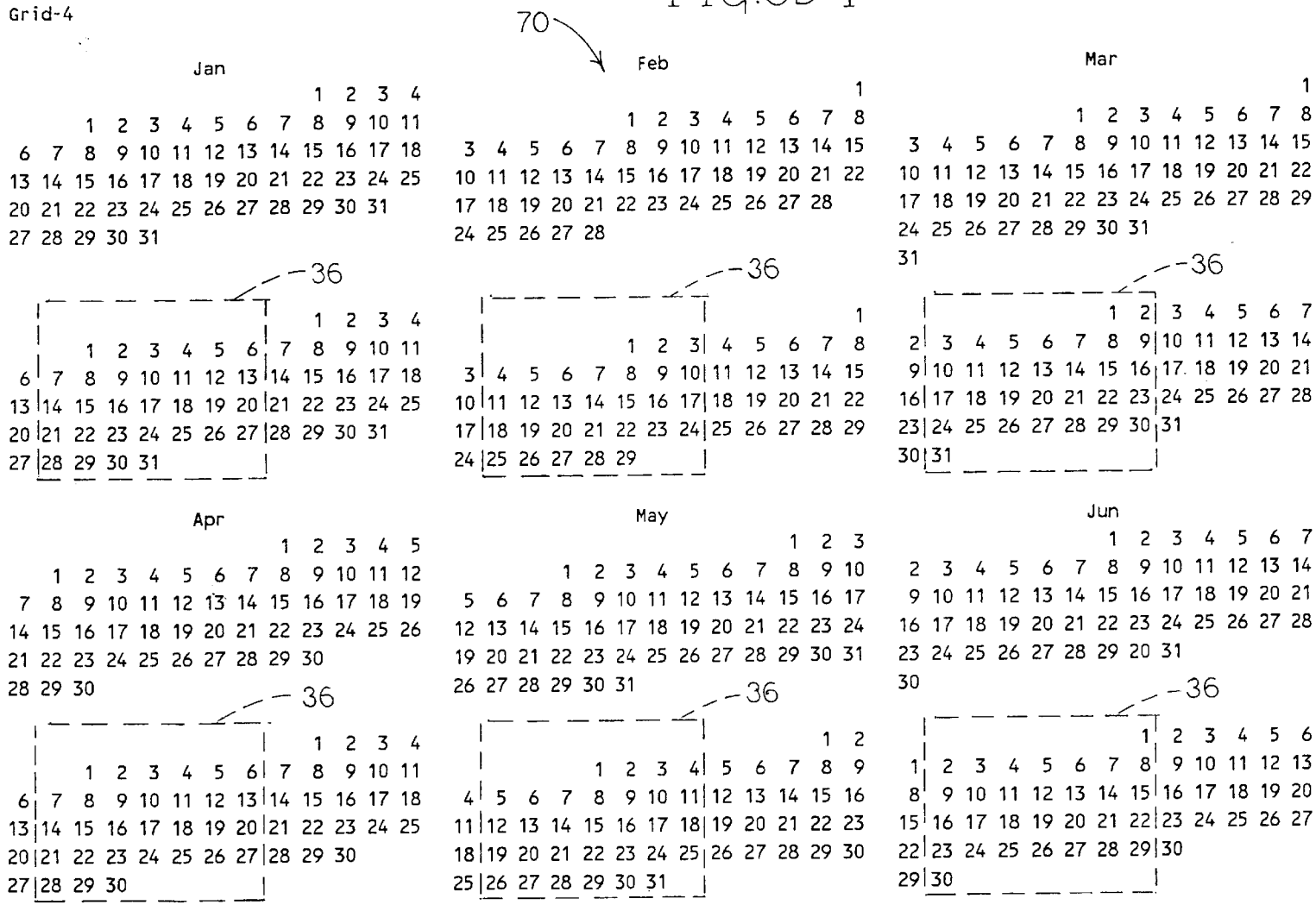
Figures 2, 6D:
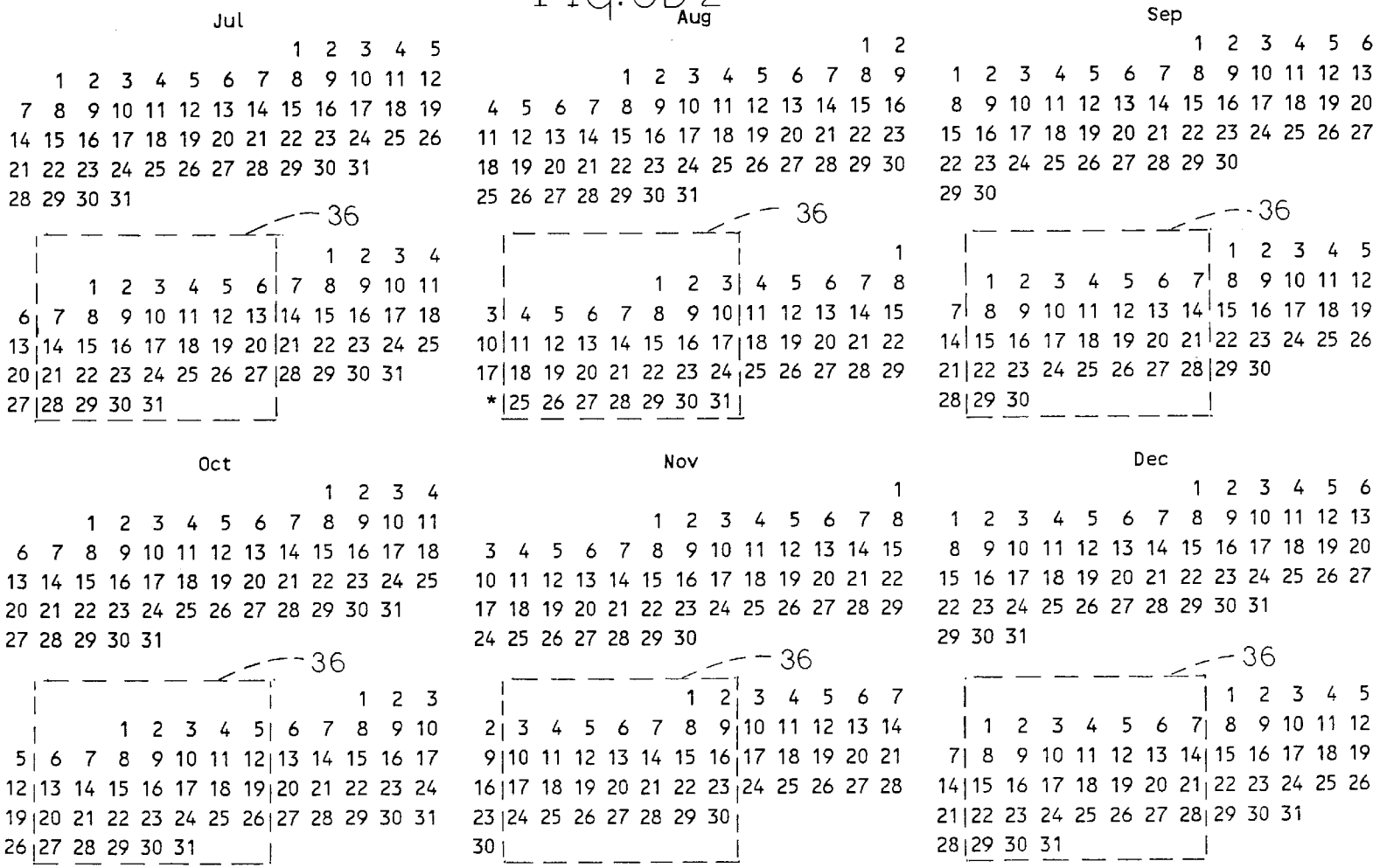

Examples of the operation of the perpetual calendar 10 of the invention are shown using grids 70*b*–70*d*, which are respectively shown in FIGS. 6B–6D. In FIG. 6B, the twelve month-windows 36 are shown in dotted lines, and the calendar grid 70*b* is in a yearly position in which the left-most section of dates in the common year grids 72*a* are displayed in the month-windows 36. In this position, the perpetual calendar 10 is displaying the twelve months of the year 1995. In another example shown in FIG. 6C, calendar grid 70*c* is used and is also displaying the year 1995. However, because the calendar grid 70*c* is numerically configured slightly differently from calendar grid 70*b*, different sections of the common year grids 72*a* are displayed behind the month-windows 36 to display the dates of the year 1995. FIG. 6D shows an example of the year 1996, which is a leap year, being displayed using calendar grid 70*d*. Here, the leap year grids 72*b* of each month-grid 72 are used and the grid 72*b* is oriented such that the appropriate section of the leap year grids 72*b* are displayed in the month-windows 36.

While the middle panel 60 and calendar grid 70 displayed thereon may be manually repositioned inside the housing sleeve 12 by, for example, access through an opening in one edge of the housing sleeve 12 or by exerting lateral pressure on the middle panel 60 through the month-windows 36 by one's fingers, the perpetual calendar of the invention preferably includes structure that functions as a positioning means. This positioning structure or means enables a user to easily and accurately position the middle panel 60 in one of the fourteen yearly positions according to calculated yearly chronology, thereby resulting in the twelve month-grids 72 being oriented in the month-windows 36 in such a manner as to display the dates of a predetermined year.

Figure 3:
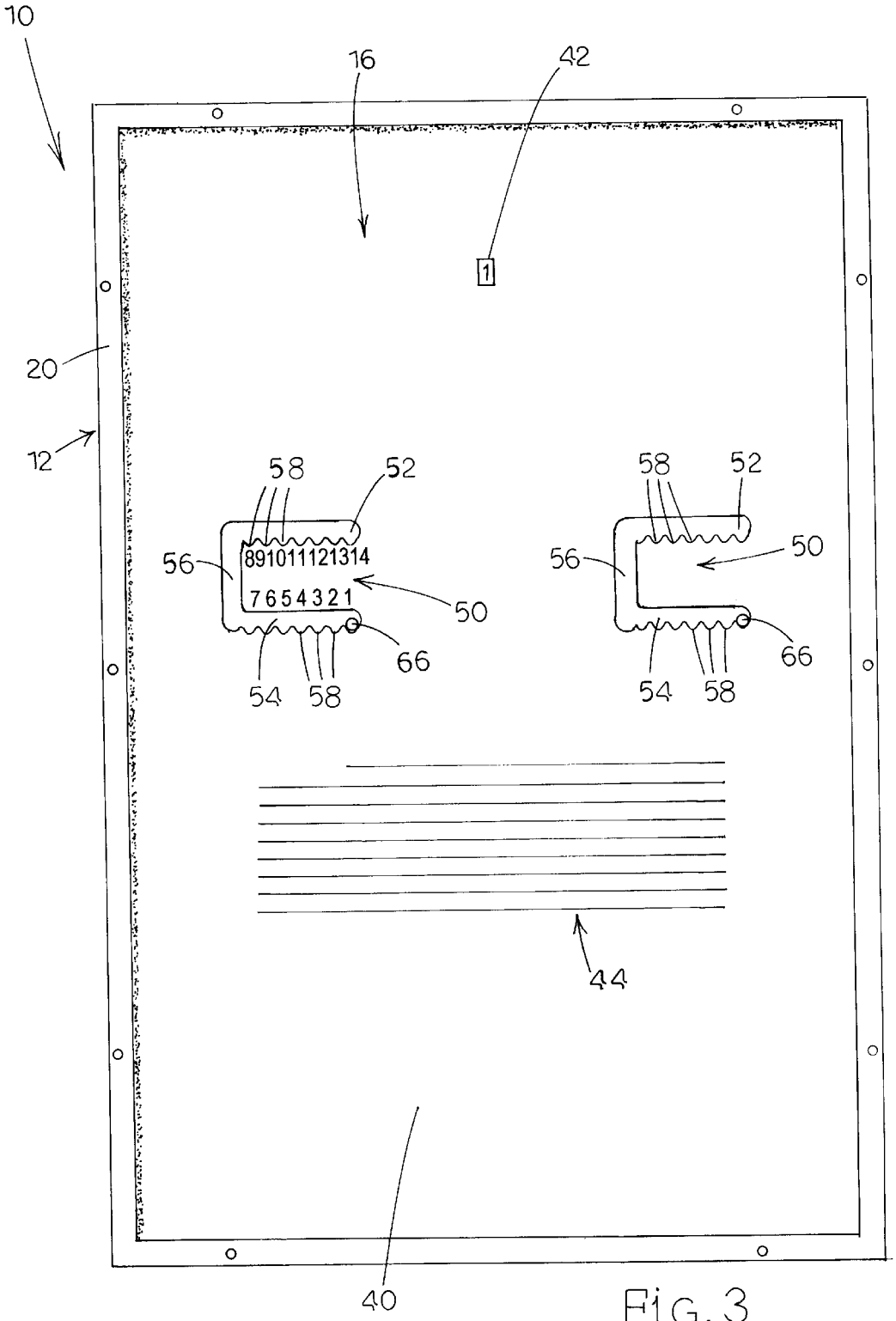
FIG. 3 is a depiction of the back face of the perpetual calendar, which shows the C-shaped slots of the positioning means and another position number window.

Referring now to FIG. 3, the positioning means preferably includes two generally C-shaped slots 50 in the back panel 16 of the housing sleeve 12. Each C-shaped slot 50 includes an upper horizontal portion 52 and a lower horizontal portion 54 that each include seven distinct yearly position demarcations 58. Each of the demarcations correspond to one of the fourteen yearly positions in which the middle panel 60 may be disposed to display any calendar year and are preferably labeled as such. The yearly position demarcations 58 may merely be indicia on the back panel 16; but preferably, the yearly position demarcations 58 include indentations in the bottom edges of the upper and lower horizontal portions 52, 54 of the slot 50. The purpose of these demarcating indentations 58 will become apparent upon a further reading of the description of the positioning means. Each C-shaped slot 50 also includes a connecting portion 56 that communicatively connects the upper and lower horizontal portions 52, and 54. The connecting portion 56 has no function other than to communicatively connect the horizontal portions 52, 54 and therefore may be any shape. Here the connecting portion 56 is generally vertical, although it is conceived that the slots 50 would function in the same manner with reversed-C-shapes or with Z-shapes. As should be appreciated, one of the horizontal portions is for common year positioning of the middle panel 60, while the other horizontal portion is for leap year positioning of the middle panel 60. It should also be appreciated that for alternate configurations of the calendar 10, such as where the common year grid 72*a* and leap year grid 72*b* are disposed horizontally beside one another instead of above and below one another, the slot 50 could be a single elongated slot having the common year demarcations at one end and the leap year demarcations at the other. In addition only one slot or more than two slots could be provided.

Preferably, the positioning means further includes two elongated positioning members 66 protruding from the back face 64 of the middle panel 60 through respective C-shaped slots 50. See FIGS. 2, 3, and 5. It is contemplated that the positioning members 66 may take any of several possible forms, including threaded bolts or relatively smooth knobs. The positioning members 66 are movable between the upper 52 and lower 54 horizontal portions of the C-shaped slots 50 through the connecting portions 56 and cooperate with the yearly position demarcations 58 to position the middle panel 60 in the yearly positions. In the embodiment described above wherein the yearly position demarcations 58 include indentations, portions of the positioning members 66 are received in the demarcating indentations 58 so that the precise yearly positioning is achieved. In addition, as shown in FIG. 2, the positioning members 66 may include locking devices such as wing nuts 67 or clamping devices outside the back panel 16 for securing the middle panel 60 in a fixed yearly position to prevent accidental reorientation of the month-grids 72 in the month-windows 36 during a particular year.

To determine the yearly position required to orient the month-grids 72 so that they display a certain year, the perpetual calendar 10 of the invention preferably includes a chart 80, which is depicted in FIG. 7. This chart is adapted for use with calendar grid 70*b* shown in FIG. 6B; however, with minor adaptations that will be appreciated by those skilled in the art, the chart could be altered slightly for use with any of the other calendar grid variations. The chart 80 may be separate from the calendar 10, but for convenience, the chart 80 is preferably printed on the outer housing sleeve 12 such as on the back panel 14. As is known, calendars generally follow a 28 year cycle; that is, a calendar used in one year could usually be used again 28 years later. In the chart 80 shown in FIG. 7, yearly position indicators 74 such as numerals 1–14 are arranged in a column on the left. Calendar years 82 are arranged beside the yearly position numbers 74 in the right section of the chart 80. To determine the yearly position required for the middle panel 60 to display a certain year, that year is found in the year portion 82 of the chart 80 and the correct position number 74 is found in the position number column on the left. For example with this chart 80, the year 1995 requires the middle panel 60 (and calendar grid 70*b*) to be in position number 1. For the year 1996 (a leap year), the middle panel 60 and calendar grid 70*b* must be in position number 9. Thus, the correct yearly position is determined by corresponding calendar years to the fourteen yearly position indicator numbers. These fourteen yearly positions numbers 74 are preferably indicated adjacent the appropriate demarcations 58 in the C-shaped slots 50. Therefore, to orient the middle panel 60 and therefore the calendar grid 70 in the correct yearly position, the user must merely position the positioning member 66 at the appropriate demarcation or indentation 58 for a desired calendar year.

Figure 5:
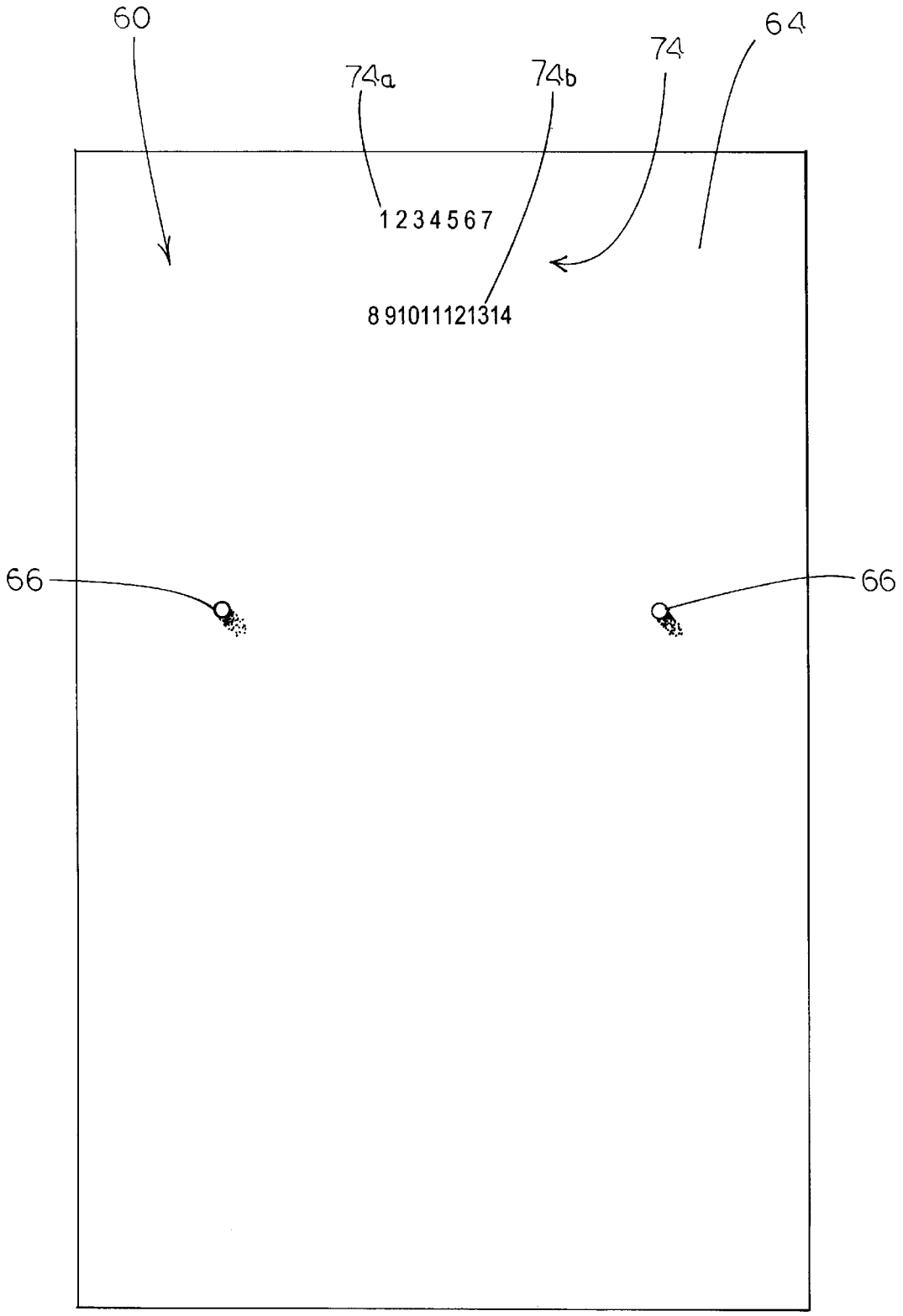
FIG. 5 depicts the back face of the middle panel, showing two sets of seven position numbers as well as two positioning members protruding from the middle panel.

Preferably, the perpetual calendar 10 of the invention includes position indicia are provided to display the current yearly position in which the calendar grid 70 is oriented on either the front face 30 of the front panel 14 or the back face of the back panel 16 or both. Referring particularly to FIGS. 4 and 5, the position indicia therefore preferably includes at least one set of fourteen position numbers 74 on the middle panel 60, which correspond to the fourteen yearly positions of the calendar grid 70. These position numbers 74 shown in the drawings correspond to the calendar grid 70*a* shown in FIG. 6A. However, with minor modifications of numeral order, the position indicia could reflect the yearly positions used for any of the other calendar grid variations. Preferably, with the embodiment of the calendar grid having common year grids 72*a* above the leap year grids 72*b*, each set of position numbers 74 includes two adjacent rows of seven position numbers each, the top row 74*a* including position numbers for yearly positions of common years, the bottom row 74*b* including position numbers for yearly positions of leap years. Like the horizontal portions 52, 54 of the slot 50 in the back panel 16, the relative disposition of the position numbers 74 on the faces of the middle panel 60 depends on the configuration of the month-windows 36 and the month-grids 72.

To display individual position numbers 74 that correspond to particular yearly positions, at least one position number window 42 is provided in the outer housing sleeve 12. In the drawings, the calendar 10 of the invention is shown having position indicia 74 on both the front and back of the middle portion 60 as well as position number windows 42 on both the front and back panels 14, 16 of the outer housing sleeve 12. Each window 42 preferably displays only the position number that reflects the current orientation of the middle panel 60 and calendar grid 70.

The perpetual calendar 10 of the present invention includes twelve month-windows for simultaneously and individually displaying all twelve months of any chosen year, yet has the appearance of a conventional single-year calendar to avoid the possibility of errors and confusion when reading the perpetual calendar. The perpetual calendar of the invention displays leap years in the same manner as common years, requiring no special calculations or steps for leap years, and displays the correct number of days in each month. In addition, the perpetual calendar of the invention preferably includes a positioning apparatus that permits easy reorientation of the calendar to different yearly positions, yet also securely holds the calendar in place in a chosen yearly position so that it cannot be accidentally disturbed and repositioned in an erroneous yearly position.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A perpetual calendar, comprising:

a) an outer housing sleeve, including
   i) a front panel that includes twelve month-windows,
   ii) a back panel joined around a periphery thereof to a periphery of said front panel, and
   iii) a space defined between said front and back panels;

b) a middle panel disposed in the space between said front and back panels and movable among a plurality of distinct yearly positions; and c) a calendar grid adorning a front face of said middle panel and including twelve month-grids for simultaneously and individually displaying the days of all twelve months of any year through the respective twelve month-windows formed in the front panel, each of said month-grids including
   i) a common year grid, and
   ii) a leap year grid adjacent to said common year grid,
   iii) wherein during a common year, a selected section of said common year grid is displayed in an appropriate month-window while said leap year grid is hidden from view, and
   iv) wherein during a leap year, a selected section of said leap year grid is displayed in the appropriate month-window while said common year grid is hidden from view.

2. The perpetual calendar according to claim 1, wherein said front panel includes month-indicia adorning a front face of the front panel adjacent said month-windows.

3. The perpetual calendar according to claim 2, wherein said twelve month-windows in said front panel and said month-grids on said middle panel are both arranged in a relationship selected from one of the following group: three columns×four rows; four columns×three rows; two columns×six rows; six columns×two rows; one column× twelve rows; and twelve columns×one row.

4. The perpetual calendar according to claim 1, wherein said outer housing sleeve further includes a peripheral spacing member for separating said front panel from said back panel to define the space therebetween.

5. The perpetual calendar according to claim 4, wherein said peripheral spacing member includes exterior molding extending around the periphery of said outer housing sleeve, said exterior molding including a front panel slot in which is disposed said front panel, a back panel slot in which is disposed said back panel, and a middle panel slot in which said middle panel may be received.

6. The perpetual calendar according to claim 1, wherein said middle panel includes spacers protruding from at least one face thereof for reducing friction between said middle panel and said outer housing sleeve as said middle panel is moved between yearly positions.

7. The perpetual calendar according to claim 1, further comprising positioning means for positioning said middle panel in one of fourteen yearly positions according to calculated yearly chronology, thereby resulting in said twelve month-grids being oriented in said month-windows in such a manner as to display the days of any predetermined year on the perpetual calendar.

8. The perpetual calendar according to claim 7, wherein said positioning means includes: at least one slot in said outer housing sleeve, said slot including distinct yearly position demarcations; and at least one positioning member protruding from said middle panel through said at least one slot in said outer housing sleeve, each said at least one positioning member cooperating with said yearly position demarcations to position said middle panel in said yearly positions.

9. The perpetual calendar according to claim 8, wherein said at least one positioning member protrudes from a back face of said middle panel; and wherein said at least one slot includes at least one generally C-shaped slot in said back panel, each said at least one C-shaped slot including upper and lower horizontal portions that each include seven yearly positions, and each said at least one C-shaped slot also including a connecting portion that communicatively connects said upper and lower horizontal portions to permit said positioning member to be moved between said upper and lower horizontal portions.

10. The perpetual calendar according to claim 8, wherein each said positioning member includes a locking device for securing said middle panel in a fixed yearly position to prevent accidental re-orientation of said month-grids in said month-windows.

11. The perpetual calendar according to claim 8, wherein said yearly position demarcations include indentations in a bottom edge of said at least one slot, said indentations for receiving a corresponding portion of said positioning member.

12. The perpetual calendar according to claim 7, further comprising: position indicia adorning at least one face of said middle panel, said position indicia including fourteen position indicators of the fourteen yearly positions; and at least one position indicator window in said outer housing sleeve for displaying the position indicator that corresponds to a particular yearly position.

13. The perpetual calendar according to claim 12, further comprising a chart adorning said outer housing sleeve for enabling determination of the yearly position of said middle panel required to orient said month-grids so that they display a certain calendar year, the yearly position determined by corresponding calendar years to the fourteen yearly position indicators.

14. The perpetual calendar according to claim 12, wherein said position indicia includes two adjacent rows of seven position indicators each, one of said rows including position indicators for yearly positions of common years, the other of said rows including position indicators for yearly positions of leap years.

15. A perpetual calendar that simultaneously and individually displays all twelve months of any predetermined year, comprising:

a) a frame structure that includes twelve distinct month-windows;

b) an adjustable display that is movable among fourteen distinct yearly positions behind said month-windows; and c) a numerical calendar grid adorning said adjustable display and including twelve month-grids for simultaneously displaying all twelve months of any particular year individually through the month-windows when said adjustable display is oriented into a particular yearly position, each of said month-grids including i) a common year grid movable among seven common year positions, and ii) a leap year grid adjacent to said common year grid and movable among seven leap year positions, iii) wherein during a common year, a selected section of said common year grid is displayed in a respective one of said month-windows while said leap year grid is hidden from view, and iv) wherein during a leap year, a selected section of said leap year grid is displayed in the respective month-window while said common year grid is hidden from view, wherein each of said twelve month-grids is configured to display only a single selected month and to display the precise number of days in the selected month.

16. The perpetual calendar according to claim 15, wherein in each said month-grid, said common year grid and said leap year grid are arranged one above the other in a vertical relationship.

17. The perpetual calendar according to claim 15, wherein in each said month-grid, said common year grid and said leap year grid are arranged side-by-side in a horizontal relationship.

18. The perpetual calendar according to claim 15, further comprising: at least one set of fourteen position numbers adorning said adjustable display that correspond to the fourteen yearly positions; and at least one position number window in said frame structure for displaying individual position numbers that correspond to particular yearly positions; wherein each set of position numbers includes two adjacent rows of seven position numbers each, one of said rows including position numbers for yearly positions of common years, the other of said rows including position numbers for yearly positions of leap years.

19. A perpetual calendar that simultaneously and individually displays all twelve months of any predetermined year, comprising:

a) an outer housing sleeve, including i) a generally planar front panel that includes twelve month-windows separated by intervening portions and month-indicia designating each of the twelve months adorning a front face of the front panel adjacent said month-windows, ii) a generally planar back panel joined around a periphery thereof to a periphery of said front panel, and iii) a space defined between said front and back panels;

b) a middle panel movably disposed in the space between said front and back panels that may be oriented among fourteen distinct yearly positions;

c) a calendar grid adorning a front face of said middle panel and including twelve month-grids for simultaneously displaying the days of all twelve months of any year individually in said month-windows, each of said month-grids including i) a common year grid movable among seven common year positions, and ii) a leap year grid adjacent to said common year grid and movable among seven leap year positions, iii) wherein during a common year, a selected section of said common year grid is displayed in a respective one of said month-windows while said leap year grid is hidden from view behind an adjacent intervening portion, and iv) wherein during a leap year, a selected section of said leap year grid is displayed in the respective month-window while said common year grid is hidden from view behind an adjacent intervening portion, wherein each of said twelve month-grids is configured to display only a single selected month and to display the precise number of days in the selected month; and d) positioning means for positioning said middle panel in one of the fourteen yearly positions according to calculated yearly chronology, thereby resulting in said twelve month-grids being oriented in said month-windows in such a manner as to display the dates of a predetermined year, said positioning means including i) two generally C-shaped slots in said back panel, each said C-shaped slot including upper and lower horizontal portions that each include seven distinct yearly position demarcations, each said C-shaped slot also including a connecting portion that communicatively connects said upper and lower horizontal portions, and ii) two elongated positioning members protruding from a back face of said middle panel through respective C-shaped slots, said positioning members movable between said upper and lower horizontal portions of said C-shaped slots through said connecting portions, said positioning members cooperating with said yearly position demarcations to position said middle panel in said yearly positions.

20. The perpetual calendar according to claim 19, further comprising: at least one set of fourteen position numbers adorning said middle panel that correspond to the fourteen yearly positions; and at least one position number window in said outer housing sleeve for displaying individual position numbers that correspond to particular yearly positions; wherein each set of said position numbers includes two adjacent rows of seven position numbers each, one of said rows including position numbers for yearly positions of common years, the other of said rows including position numbers for yearly positions of leap years.

21. A perpetual calendar, comprising:

a) an outer housing sleeve, including:

i) a front panel that includes twelve month-windows, ii) a back panel joined around a periphery thereof to a periphery of said front panel, and iii) a space defined between said front and back panels;

b) a middle panel disposed in the space between said front and back panels and movable among a plurality of distinct yearly positions;

c) a calendar grid adorning a front face of said middle panel and including twelve month-grids for simultaneously and individually displaying the days of all twelve months of any year, each of said month-grids including:

i) a common year grid, ii) a leap year grid adjacent to said common year grid, iii) wherein during a common year, a selected section of said common year grid is displayed in an appropriate month-window while said leap year grid is hidden from view, and iv) wherein during a leap year, a selected section of said leap year grid is displayed in the appropriate month-window while said common year grid is hidden from view; and d) positioning means for positioning said middle panel in one of fourteen yearly positions according to calculated yearly chronology, thereby resulting in said twelve month-grids being oriented in said month-windows in such a manner as to display the days of any predetermined year on the perpetual calendar; and e) wherein said positioning means includes: at least one slot in said outer housing sleeve, said slot including distinct yearly position demarcations; and at least one positioning member protruding from said middle panel through said at least one slot in said outer housing sleeve, each said at least one positioning member cooperating with said yearly position demarcations to position said middle panel in said yearly positions.

* * * * *